US010182639B2

(12) United States Patent
Picking

(10) Patent No.: US 10,182,639 B2
(45) **Date of Patent: *Jan. 22, 2019**

(54) PACK ASSEMBLY FOR A MOBILE DEVICE

(71) Applicant: UVu, LLC, Phoenix, AZ (US)

(72) Inventor: Karl D. Picking, Gardnerville, NV (US)

(73) Assignee: UVU, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/926,595

(22) Filed: Mar. 20, 2018

(65) Prior Publication Data

US 2018/0206619 A1 Jul. 26, 2018

Related U.S. Application Data

(63) Continuation-in-part of application No. 15/256,536, filed on Sep. 3, 2016, now Pat. No. 9,923,590.

(60) Provisional application No. 62/214,132, filed on Sep. 3, 2015.

(51) Int. Cl.

| | |
|---|---|
| ***A45F 3/04*** | (2006.01) |
| ***A45F 3/14*** | (2006.01) |
| *A45C 11/00* | (2006.01) |

(52) U.S. Cl.

CPC ..... *A45F 3/04* (2013.01); *A45F 3/14* (2013.01); *A45C 2011/002* (2013.01); *A45F 2003/045* (2013.01); *A45F 2003/142* (2013.01); *A45F 2003/146* (2013.01); *A45F 2200/0516* (2013.01); *A45F 2200/0525* (2013.01)

(58) Field of Classification Search

USPC ..... 455/575.6, 550.1, 556.1, 575.1

See application file for complete search history.

(56) References Cited

U.S. PATENT DOCUMENTS

| | | | | |
|---|---|---|---|---|
| 4,320,863 | A * | 3/1982 | Lyer | A45F 3/14 224/259 |
| 4,461,411 | A * | 7/1984 | Harrow | A45F 5/00 224/258 |
| 5,323,942 | A * | 6/1994 | Dahan | A45C 11/38 224/639 |
| 8,960,511 | B2 * | 2/2015 | Shepherd | A45C 3/00 224/259 |
| 9,244,337 | B2 * | 1/2016 | Weihe | G03B 17/561 |
| 2006/0175370 | A1 * | 8/2006 | Arney | A45F 5/02 224/666 |

(Continued)

FOREIGN PATENT DOCUMENTS

WO WO 2012151200 A1 * 11/2012 ..... A47F 3/14

*Primary Examiner* — Fayyaz Alam

(74) *Attorney, Agent, or Firm* — Quarles & Brady LLP

(57) ABSTRACT

A wearable pack assembly for a mobile device having a touchscreen and a camera. The wearable pack assembly includes a harness and a pack. The harness includes a base and a strap assembly configured to be worn by a wearer. The pack is removably coupled to the base and includes a windowed pocket and a door. The windowed pocket includes an inlet configured to receive the mobile device and a window configured to enable viewing and touching of the touchscreen and taking of pictures and video with the camera from the windowed pocket through the window. The door is movable between an open position away from the windowed pocket and a closed position partially covering the windowed pocket and leaving a portion of the window uncovered.

20 Claims, 26 Drawing Sheets

(56) References Cited

U.S. PATENT DOCUMENTS

| | | | | |
|---|---|---|---|---|
| 2010/0116860 | A1* | 5/2010 | Tello | A45F 3/04 224/576 |
| 2012/0267409 | A1* | 10/2012 | Chavis | A45F 5/00 224/579 |
| 2013/0004153 | A1* | 1/2013 | McKee | F16M 11/041 396/420 |
| 2013/0256346 | A1* | 10/2013 | Rohrbach | A45F 5/00 224/222 |
| 2013/0342969 | A1* | 12/2013 | Krupich | A45F 5/00 361/679.01 |
| 2015/0060506 | A1* | 3/2015 | Cameron | A45C 11/00 224/267 |
| 2015/0150359 | A1* | 6/2015 | Lowry | A45F 5/00 224/222 |
| 2015/0208789 | A1* | 7/2015 | Pylkovas | A45F 3/02 224/607 |
| 2017/0055683 | A1* | 3/2017 | Willows | A45F 3/14 |
| 2017/0142299 | A1* | 5/2017 | Brown | G06F 1/163 |

* cited by examiner

PACK ASSEMBLY FOR A MOBILE DEVICE

CROSS-REFERENCE TO RELATED APPLICATION

This application is a continuation-in-part of U.S. patent application Ser. No. 15/256,536, filed on Sep. 3, 2016, which claims the benefit of U.S. Provisional Patent Application No. 62/214,132, filed Sep. 3, 2015, the entire contents of which are incorporated herein by reference.

FIELD OF THE INVENTION

The present invention relates to mobile devices and, more particularly, to a wearable pack assembly useful for holding a mobile device having a camera for employing the camera of the mobile device as a body camera for recording the wearer's interactions with the environment and others.

BACKGROUND OF THE INVENTION

A body camera is a body-worn camera useful for recording the wearer's interactions with the environment and others. There are a variety of exemplary body cameras known in the art, the popularity of which has risen in recent years amongst outdoor enthusiasts and law enforcement personnel who use the technology to record their outdoor and law enforcement activities. Although body cameras are useful and popular, they are expensive, bulky, cumbersome when worn, and single-purpose, having no other use other than recording video.

The technology of mobile devices has advanced significantly in recent years. Of particular significance are the improvements in mobile device cameras, which are capable of taking high-definition and high-quality pictures and video. In view of the inherent expensive and single-purpose characteristics of dedicated body cameras, and the inherent multi-purpose functionality of mobile devices, users have begun to use their mobile devices to take pictures and videos of their activities. Typically, the user will hold and operate the mobile device by hand for taking pictures and video during a given activity. However, operating the mobile device by hand while performing an activity is inherently distracting and routinely results in accidents resulting in bodily injury and, in some cases, even death. Mobile devices are often dropped and damaged as well. Given these and other deficiencies in the art, there is a need for a wearable useful with a mobile device for enabling a user to take pictures and video with the mobile device without the need to hold the mobile device by hand and which also protects the mobile device from becoming dropped and damaged from exposure to external influences.

SUMMARY OF THE INVENTION

According to some embodiments, a wearable pack assembly for a mobile device having a touchscreen and a camera includes a harness, and a pack. The harness including a base and the pack is removably coupled to the base. The pack includes a windowed pocket having an inlet configured to receive the mobile device and to enable viewing and touching of the touchscreen and taking of pictures and video with the camera from the windowed pocket. The pack also includes door movable between an open position away from the windowed pocket and a closed position at least partially covering the windowed pocket. The door is configured to enable the camera to take pictures and video through the windowed pocket when the door is in the closed position. The harness positions the pack ahead of a chest of an upper torso of a wearer, with the windowed pocket facing outwardly relative to the chest of the upper torso of the wearer, when the harness is worn on the upper torso of the wearer.

The pack further includes an engagement assembly removably coupling the pack to the base. The pack also includes a spacer carried by the base. The spacer is configured to interact between the base and the chest of the upper torso of the wearer for concurrently tipping the base and the pack upwardly or downwardly relative to the chest of the upper torso of the wearer when the harness is worn by the upper torso of the wearer. The wearable pack assembly also includes a latch assembly configured to secure the door to the pack when the door is in the closed position. The latch assembly includes a hook and loop fastener having an element thereof carried by the door and a complemental element thereof carried by the pack. Additionally, the harness includes a strap assembly coupled to the base. The strap assembly includes a waist strap configured to extend around a waist of the wearer, shoulder straps configured to extend over shoulders of the wearer toward the back of the wearer, and a ring configured to interconnect the shoulder straps and the waist strap.

According to some embodiments, a wearable pack assembly for a mobile device having a touchscreen and a camera includes a harness, and a pack. The harness includes a base and a strap assembly configured to be worn by a wearer. The pack is removably coupled to the base and includes a windowed pocket and a door. The windowed pocket includes an inlet configured to receive the mobile device and a window configured to enable viewing and touching of the touchscreen and taking of pictures and video with the camera from the windowed pocket through the window. The door is movable between an open position away from the windowed pocket and a closed position partially covering the windowed pocket and leaving a portion of the window uncovered.

The pack further includes a fastening element configured to close the inlet of the windowed pocket. Also, the pack is removably coupled to the base by one of hook and loop fasteners and buckles. The pack further includes a flap configured to secure the door in the closed position. The door is positioned off-center between a first side edge and a second side edge of the pack, and the windowed pocket is positioned equidistant between the first side edge and the second side edge. The assembly further includes a wedge-shaped spacer having an angled side configured to be coupled to an outer side of the base so as to tip the pack upward or downward when the pack is coupled to an inner side of the base.

In some embodiments, the harness is configured to be worn on an upper torso of the wearer. The strap assembly includes a left shoulder strap configured to extend over the wearer's left shoulder, a right shoulder strap configured to extend over the wearer's right shoulder, a waist strap configured to extend around the wearer's waist, and a back strap configured to be positioned along the wearer's back when the harness is worn by the wearer. The pack assembly further includes a tie-down ring configured to connect the right shoulder strap, the left shoulder strap, and the back strap, and the back strap is further coupled to the waist strap. The strap assembly also includes at least one buckle configured to be de-united and united to enable the wearer to put on the harness.

In some embodiments, the harness is configured to be worn on a leg of the wearer. The strap assembly includes a first upper strap configured to extend from a first side of the base, a second upper strap configured to extend from a second side of the base, and a leg strap configured to extend around the wearer's leg when the harness is worn by the wearer. The first upper strap is configured to be coupled to a first ring releasably coupled to a first hook member, the second upper strap is configured to be coupled to a second ring releasably coupled to a second hook member, and the first hook member and the second hook member are configured to engage a belt of the wearer when the harness is worn by the wearer. The strap assembly includes at least one buckle configured to be de-united and united to enable the wearer to put on the harness.

Consistent with the foregoing summary of illustrative embodiments, and the ensuing detailed description, which are to be taken together, the invention also contemplates associated apparatus and method embodiments.

DETAILED DESCRIPTION

Figure 1:
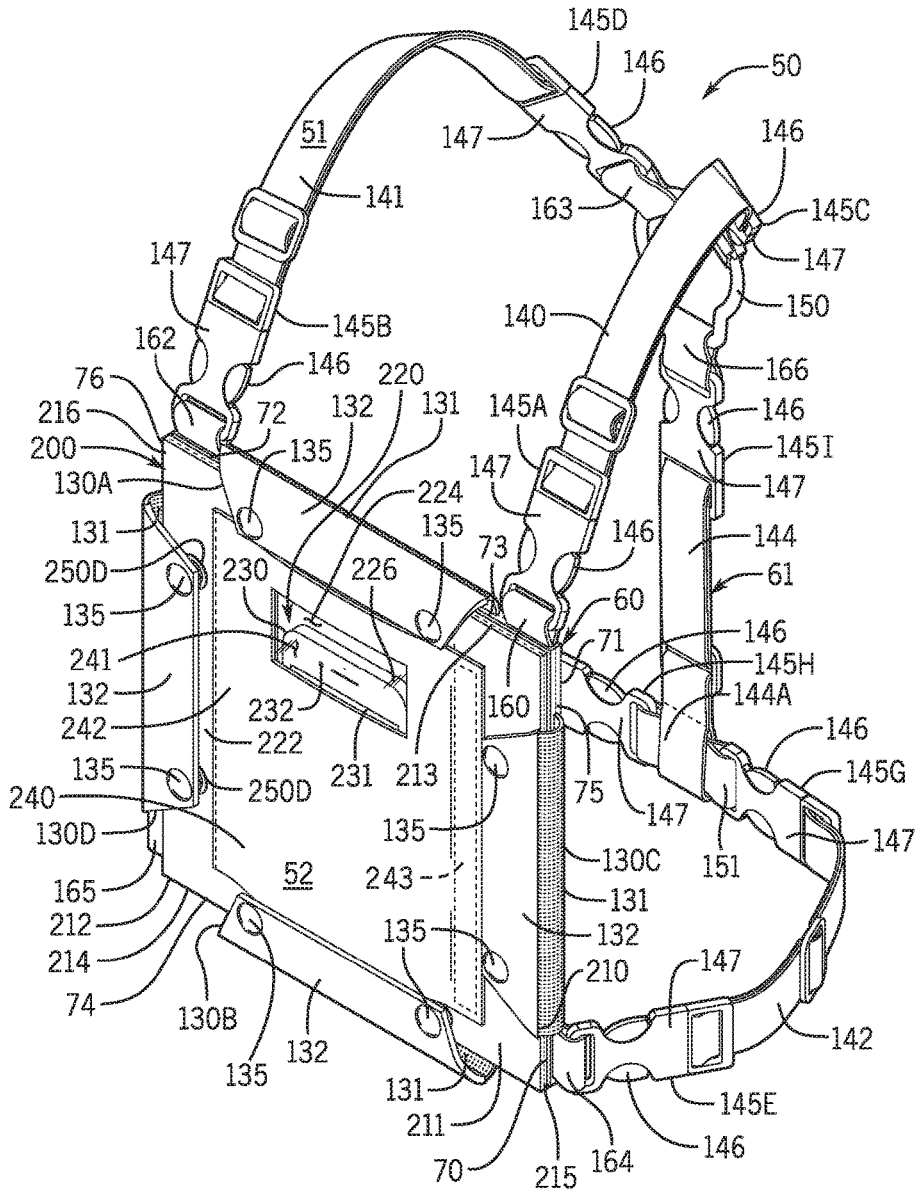
FIG. 1 is a front perspective view of a wearable pack assembly for a mobile device, the wearable pack assembly includes a harness having a base, and a pack carried by a base.

Turning now to the drawings, in which like reference characters indicate corresponding elements throughout the several views, attention is first directed to FIG. 1 in which there is seen a wearable pack assembly 50 for a mobile device. The term "mobile device" means a small computing device, typically small enough to be handheld, having a touchscreen, a display screen with touch input, and a camera. Such exemplary and ubiquitous known mobile devices include smartphones or mobile phones with an advanced mobile operating system that combines features of a personal computer operating system with other features useful for mobile or handheld use. Such mobile devices are usually pocket-sized, include features of a cell phone, such as the ability to receive and make phone calls and text messages, are enabled to access the Internet, and, again, include a graphical user interface in the nature of a touchscreen, and a camera for taking videos and still pictures.

Pack assembly 50 includes a harness 51, and a pack 52. Harness 51 is wearable, and pack 52 is configured to be carried by harness 51, and is shown as it would appear being carried by harness 51 in FIGS. 1 and 2. Pack 52 includes a windowed pocket 220 for receiving a mobile device through an opening to windowed pocket 220 so as to juxtapose a touchscreen and a camera of the mobile device with the windowed pocket to enable the viewing and the touching of the touchscreen and the taking of pictures and video with the camera in the operation of the mobile device from windowed pocket 220. Harness 51 is configured to hold pack 52 ahead of a chest of an upper torso of a wearer with windowed pocket 220 facing outwardly relative to the chest of the upper torso of the wearer when harness 51 is worn by the upper torso of the wearer and when pack 52 is carried by harness 51 for enabling the wearer to usefully employ the camera of the mobile device as a body camera for recording a wearer's interactions with the environment when the mobile device is carried operatively by the pack 52.

§ I. The Harness

Figure 2:
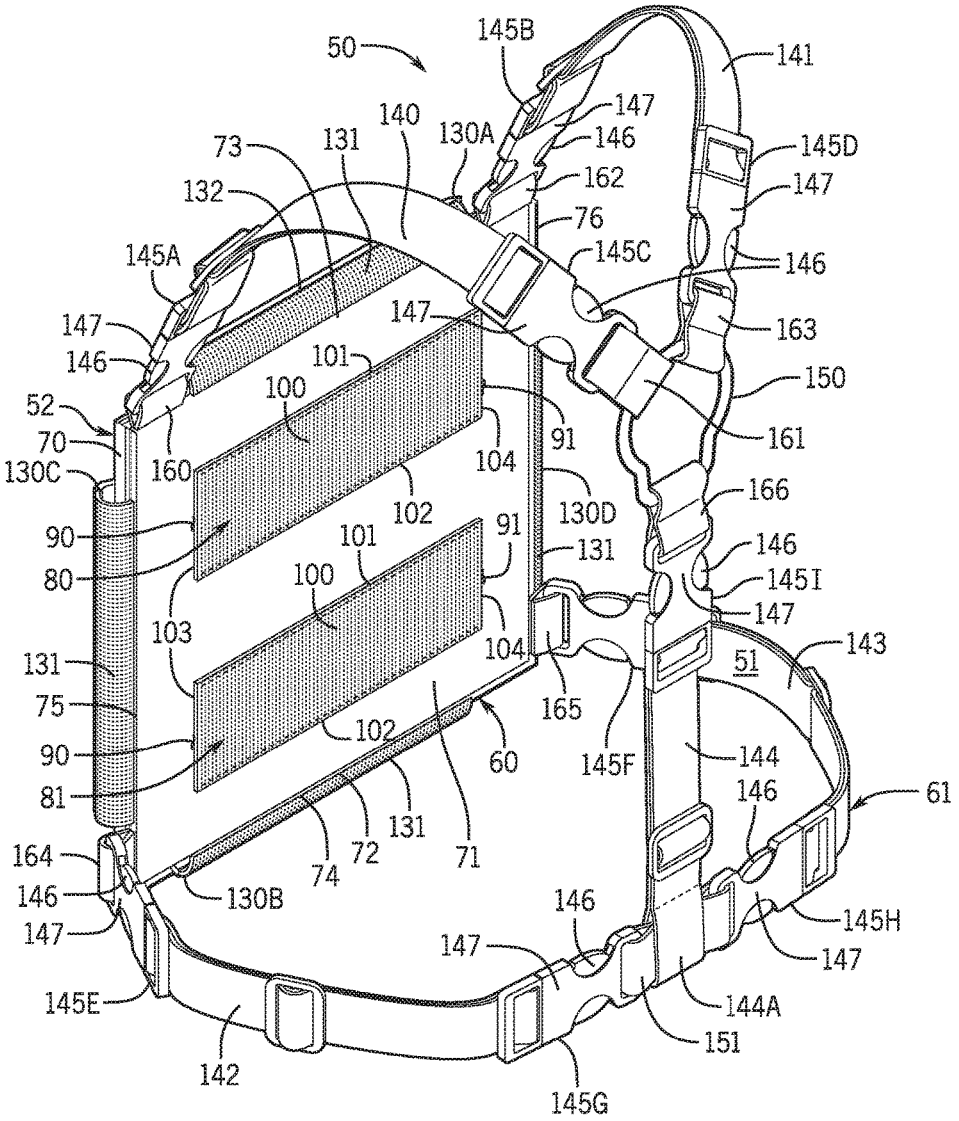
FIG. 2 is rear perspective view of the embodiment of FIG. 1 illustrating upper and lower outer sleeves formed on an outer side of the base.
Figure 12:
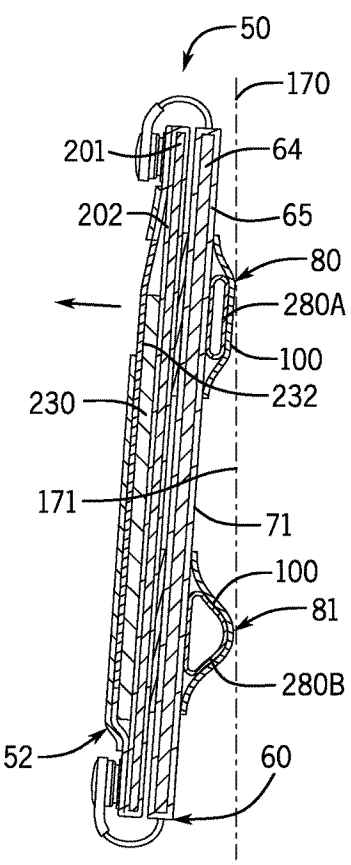
FIG. 12 is a section view corresponding to FIG. 10 illustrating the upper inflatable bladder in the upper outer sleeve of the base as it would appear deflated and the lower inflatable bladder in the lower outer sleeve of the base as it would appear inflated for concurrently tipping the base and the pack upwardly relative to a chest of an upper torso of a wearer, when the harness is worn by the upper torso of the wearer.
Figure 11:
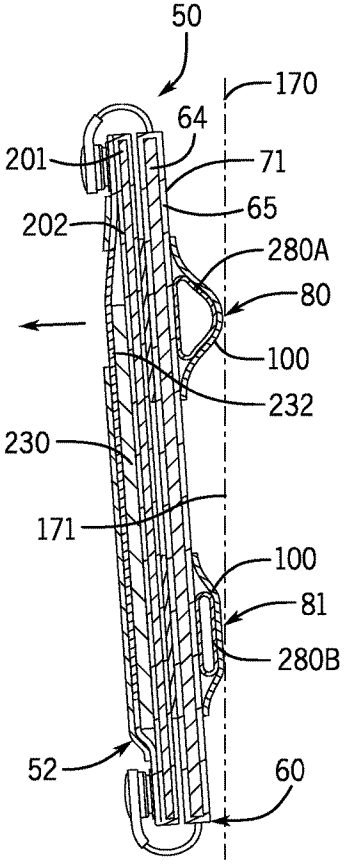
FIG. 11 is a section view corresponding to FIG. 10 illustrating the upper inflatable bladder in the upper outer sleeve of the base as it would appear inflated and the lower inflatable bladder in the lower outer sleeve of the base as it would appear deflated for concurrently tipping the base and the pack downwardly relative to a chest of an upper torso of a wearer, when the harness is worn by the upper torso of the wearer.
Figure 10:
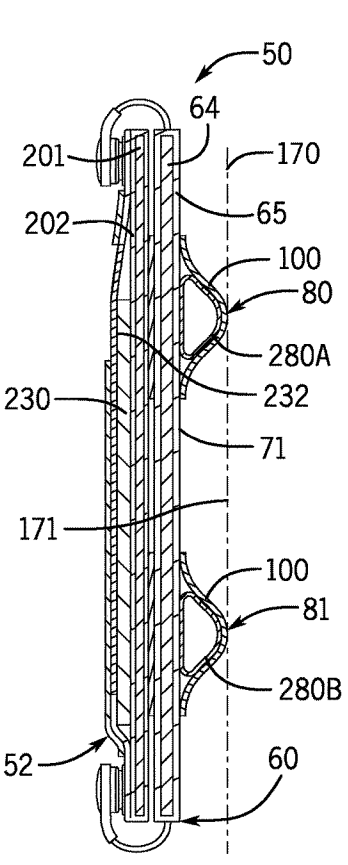
FIG. 10 is a section view taken along line 10-10 of FIG. 9.

Referring to FIGS. 1 and 2, harness 51 includes base 60, and strap assembly or system 61. Base 60 is flat and generally square in overall shape. Base 60 is a panel assembly including, as shown in FIGS. 10-12, panel 64 covered with outer layering 65 consisting of one or more layers of material. Panel 64 is fashioned of plastic, wood, metal, or other material or combination of materials having an inherently stiff material characteristic, being inherently rigid or firm and resistant to bending. Outer layering 65 is fashioned of leather, tightly woven nylon, canvas, or other material or combination of materials having the inherent properties of flexibility, resilience, tear-resistance, and ruggedness. Panel 64 is upholstered with outer layering 65, which encloses panel 64 and defines the major sides and peripheral edge of base 60 as described below.

Figure 3:
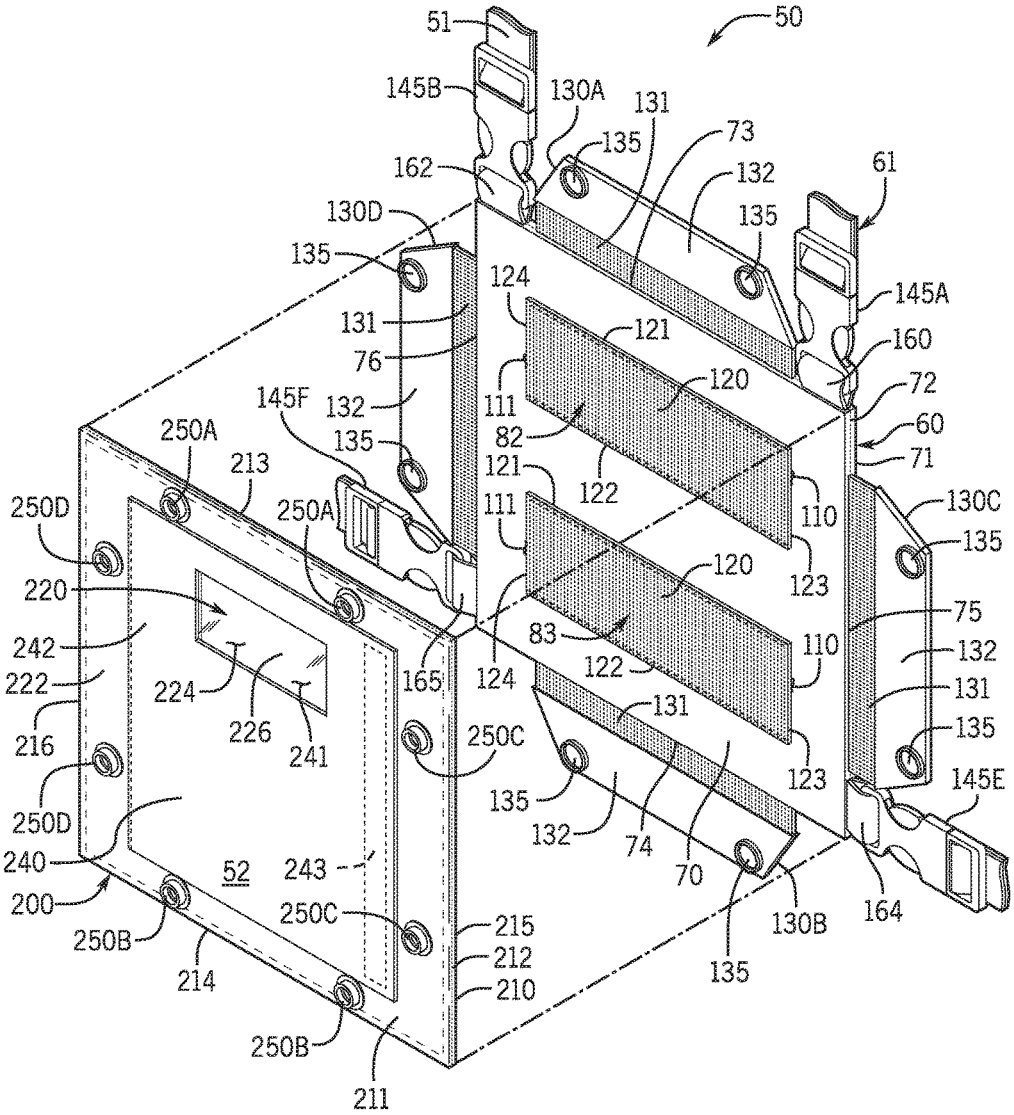
FIG. 3 is an enlarged front perspective view illustrating the pack detached from the base of the harness illustrated partially, the base being shown in an open position with upper and lower inner sleeves formed on an inner side of the base.

Referring in relevant part to FIGS. 1-3, base 60 includes inner side 70 and opposed outer side 71, and peripheral edge 72. Peripheral edge 72 is defined by first end edge 73 and opposed second end edge 74, and first side edge 75 and opposed second side edge 76 that extend from the first end edge 73 to second end edge 74. First and second end edges 73 and 74 are parallel with respect to each other, and first and second side edges 75 and 76 are parallel with respect to each other and are orthogonal with respect to first and second end edges 73 and 74. Base 60 has a length from first end edge 73 to second end edge 74 and a width from first side edge 75 to second side edge 76, and the length of base 60 and the width of base 60 are substantially the same characterizing the generally square shape of base 60. However, in some embodiments, the base 60 may instead be rectangular in shape (e.g., where the length of the base 60 and the width of the base 60 are different).

FIG. 2 illustrates upper and lower outer sleeves 80 and 81 formed on outer side 71 of base 60, and FIG. 3 illustrates upper and lower inner sleeves 82 and 83 formed on inner side 70 of base 60. Upper and lower outer sleeves 80 and 81 are parallel relative to each other, are parallel relative to first and second end edges 73 and 74, are orthogonal relative to first and second side edges 75 and 76, and are each open toward first and second side edges 75 and 76 to enable the application and withdrawal of, for example, a spacer (as described below). Upper outer sleeve 80 is adjacent to first end edge 73, and lower outer sleeve 81 is adjacent to second end edge 74. Upper and lower inner sleeves 82 and 83 are parallel relative to each other, are parallel relative to first and second end edges 73 and 74, are orthogonal relative to first and second side edges 75 and 76, and are each open toward first and second side edges 75 and 76 to enable the application and withdrawal of, for example, a spacer (as described below). Upper inner sleeve 82 is adjacent to first end edge 73, and lower inner sleeve 83 is adjacent to second end edge 74. Upper outer and inner sleeves 80 and 82 are diametrically opposed and parallel relative to each other, and lower outer and inner sleeves 81 and 83 are diametrically opposed and parallel relative to each other. Sleeves 80-83 are identical in structure, in size, and in shape.

Upper outer sleeve 80 is elongate, extends from first open end 90 near first side edge 75 to second open end 91 near second side edge 76. Upper outer sleeve 80 includes strap 100. Strap 100 is elongate and elastic being formed of elasticized material that can stretch and that can return to its original length, shape, etc., after being stretched. Strap 100 is applied across outer side 71, being parallel relative to first and second end edges 73 and 74 and orthogonal relative to first and second side edges 75 and 76, and includes opposed, parallel upper and lower major edges 101 and 102 affixed to outer side 71, such as with stitching, adhesive, heat bonding, or the like, and opposed parallel first and second minor edges 103 and 104 that extend from upper major edge 101 to lower major edge 102. Upper outer sleeve 80 is defined by strap 100 and the portion of outer side 71 opposing strap 100. First and second minor edges 103 and 104 are not affixed or otherwise adhered to outer side 71, thereby forming first and second open ends 90 and 91, respectively. Lower outer sleeve 81 is identical in every respect to upper outer sleeve 80. Accordingly, the foregoing discussion of upper outer sleeve 80 applies in every respect to lower outer sleeve 81.

Upper inner sleeve 82 is elongate, extends from first open end 110 near first side edge 75 to second open end 111 near second side edge 76. Upper inner sleeve 82 includes strap 120. Like each strap 100, strap 120 is elongate and elastic being formed of elasticized material. Strap 120 is applied across inner side 70, being parallel relative to first and second end edges 73 and 74 and orthogonal relative to first and second side edges 75 and 76, and include opposed, parallel upper and lower major edges 121 and 122 affixed to inner side 70, such as with stitching, adhesive, heat bonding, or the like, and opposed parallel first and second minor edges 123 and 124 that extend from upper major edge 121 to lower major edge 122. Upper inner sleeve 82 is defined by strap 120 and the portion of inner side 70 opposing strap 120. First and second minor edges 123 and 124 are not affixed or otherwise adhered to outer side 71, thereby forming first and second open ends 110 and 111, respectively. Lower inner sleeve 83 is identical in every respect to upper inner sleeve 82. Accordingly, the foregoing discussion of upper inner sleeve 82 applies in every respect to lower inner sleeve 83.

Pack assembly 50 includes an engagement assembly for removably coupling pack 52 to base 60. The engagement assembly includes flaps 130 carried by base 60, and fasteners 135, 250 for securing flaps 130 releasably to pack 52, as further described below. The fasteners 135, 250, which are releasable fasteners, are snap fasteners in a preferred embodiment, and can be button fasteners, hook-and-loop fasteners, or the like in alternate embodiments.

In FIG. 3, base 60 includes flaps 130 coupled to peripheral edge 72. Flaps 130 include flap 130A coupled to first end edge 73, flap 130B connected to second end edge 74, flap 130C coupled to first side edge 75, and flap 130D coupled to second side edge 76.

Flap 130A includes a proximal part 131, and a distal part 132. Proximal part 131 is coupled between first end edge 73 and distal part 132. Proximal part 131 is an elongate flap segment, is elastic being formed of elasticized material that can stretch and that can return to its original length, shape, etc., after being stretched, and is attached to first end edge 73 with stitching, adhesive, heat bonding, or the like, and extends outwardly from first end edge 73 to distal part 132 attached to proximal part 131 with stitching, adhesive, heat bonding, or the like. Distal part 132 is an elongate flap segment fashioned of leather, tightly woven nylon, canvas, or other material or combination of materials having the properties of flexibility, resilience, tear-resistance, and ruggedness, and extends outwardly from proximal part 131. Distal part 132 is formed with engagement or fastener elements 135 on either end thereof. Proximal part 131 elastically connects distal part 132 to peripheral edge 72, specifically first end edge 73. Flap 130A is centered between first and second side edges 75 and 76, and extends along a majority of the length of first end edge 73 from proximate to first side edge 75 to proximate to second side edge 76.

Flaps 130B-130D are identical to flap 130A in every respect, and the foregoing discussion of flap 130A applies to each of flaps 130B-130D. Briefly, flap 130B is centered between first and second side edges 75 and 76, extends along a majority of the length of second end edge 74 from proximate to first side edge 75 to proximate to second side edge 76, and includes proximal part 131 that extends outwardly from second end edge 74 to distal part 132 formed with engagement or fastener elements 135. Flap 130C is centered between first and second end edges 73 and 74, extends along a majority of the length of first side edge 75 from proximate to first end edge 73 to proximate to second end edge 74, and includes proximal part 131 that extends outwardly from first side edge 75 to distal part 132 formed with engagement or fastener elements 135. Flap 130D is centered between first and second end edges 73 and 74, extends along a majority of the length of second side edge 76 from proximate to first end edge 73 to proximate to second end edge 74, and includes proximal part 131 that extends outwardly from second side edge 76 to distal part 132 formed with engagement or fastener elements 135.

In FIGS. 1 and 2, strap system 61 is connected to base 60, is used to strap base 60 to the upper torso of the wearer, and includes left and right shoulder straps 140 and 141, left and right waist straps 142 and 143, and a back strap 144 interconnected with buckles 145 and looped connecting straps. Straps 140-144 are each fashioned of leather, tightly woven nylon, canvas, or other material or combination of materials having the properties of flexibility, resilience, tear-resistance, and ruggedness, and are conventionally length-adjustable straps. Each buckle 145 is a conventional slide release buckle including a male buckle member 146, the hook end, and a female buckle member 147, the catch end. In each buckle 145, male buckle member 146 includes a center guide rod forwardly extending from the front side with two spring arms equally spaced from the center rod. The two spring arms each have a retaining block that terminates at the front end. The female buckle member 147 has a front open side and two side holes which hold and secure the two spring arms of the male buckle member. This sort of buckle, which is commonly referred to as a parachute buckle, is found on backpacks, belts, rifle slings, boots, and a host of other common items. However, other buckles or fastening mechanisms may be used in other embodiments.

Left and right shoulder straps 140 and 141 are connected to first end edge 73 on either side of flap 130A with respective buckles 145A and 145B, and extend rearwardly therefrom to respective buckles 145C and 145D coupled to a tie-down ring 150. Left waist strap 142 is connected to first side edge 75 alongside flap 130C near second end edge 74 with buckle 145E, and right waist strap 143 is connected to second side edge 76 alongside flap 130D near second end edge 74 with buckle 145F. Left and right waist straps 142 and 143 extend rearwardly from base 60 to respective buckles 145G and 145H coupled to either end of a connecting strap 151. Back strap 144 interconnects tie-down ring 150 and connecting strap 151. In this embodiment, back strap 144 is connected to tie-down ring 150 with buckle 145I, and extends downwardly therefrom to looped end 144A through which connecting strap 151 extends.

In the present embodiment, connecting strap 160 attached to first end edge 73 along the left side of flap 130A proximate to first side edge 75 is coupled to female buckle member 147 of buckle 145A. Male buckle member 146 of buckle 145A is coupled releasably to female buckle member 147 of buckle 145A, and left shoulder strap 140 extends rearwardly from male buckle member 146 of buckle 145A to male buckle member 146 of buckle 145C. Female buckle member 147 of buckle 145C is coupled releasably to male buckle member 146 of buckle 145C, and connecting strap 161 couples female buckle member 147 of buckle 145C to tie-down ring 150.

Connecting strap 162 attached to first end edge 73 along the right side of flap 130A proximate to second side edge 76 is coupled to female buckle member 147 of buckle 145B. Male buckle member 146 of buckle 145B is coupled releasably to female buckle member 147 of buckle 145B, and right shoulder strap 141 extends rearwardly from male buckle member 146 of buckle 145B to male buckle member 146 of buckle 145D. Female buckle member 147 of buckle 145D is coupled releasably to male buckle member 146 of buckle 145D, and connecting strap 163 couples female buckle member 147 of buckle 145D to tie-down ring 150.

Connecting strap 164 attached to first side edge 75 along the lower side of flap 130C proximate to second end edge 74 is coupled to female buckle member 147 of buckle 145E. Male buckle member 146 of buckle 145E is coupled releasably to female buckle member 147 of buckle 145E, and left waist strap 142 extends rearwardly from male buckle member 146 of buckle 145E to male buckle member 146 of buckle 145G. Female buckle member 147 of buckle 145G is coupled releasably to male buckle member 146 of buckle 145G, and female buckle member 147 of buckle 145G is coupled to the left end of connecting strap 151.

Connecting strap 165 attached to second side edge 76 along the lower side of flap 130D proximate to second end edge 74 is coupled to female buckle member 147 of buckle 145F. Male buckle member 146 of buckle 145F is coupled releasably to female buckle member 147 of buckle 145F, and right waist strap 143 extends rearwardly from male buckle member 146 of buckle 145F to male buckle member 146 of buckle 145H. Female buckle member 147 of buckle 145H is coupled releasably to male buckle member 146 of buckle 145H, and female buckle member 147 of buckle 145H is coupled to the right end of connecting strap 151.

Connecting strap 166 couples tie-down ring 150 to female buckle member 147 of buckle 145I. Male buckle member 146 of buckle 145I is coupled releasably to female buckle member 147 of buckle 145I, back strap 144 extends downwardly from male buckle member 146 of buckle 145I to connecting strap end 144A of back strap 144, and connecting strap end 144A of back strap 144 is coupled to connecting strap 151 between its left and right ends.

Figure 6:
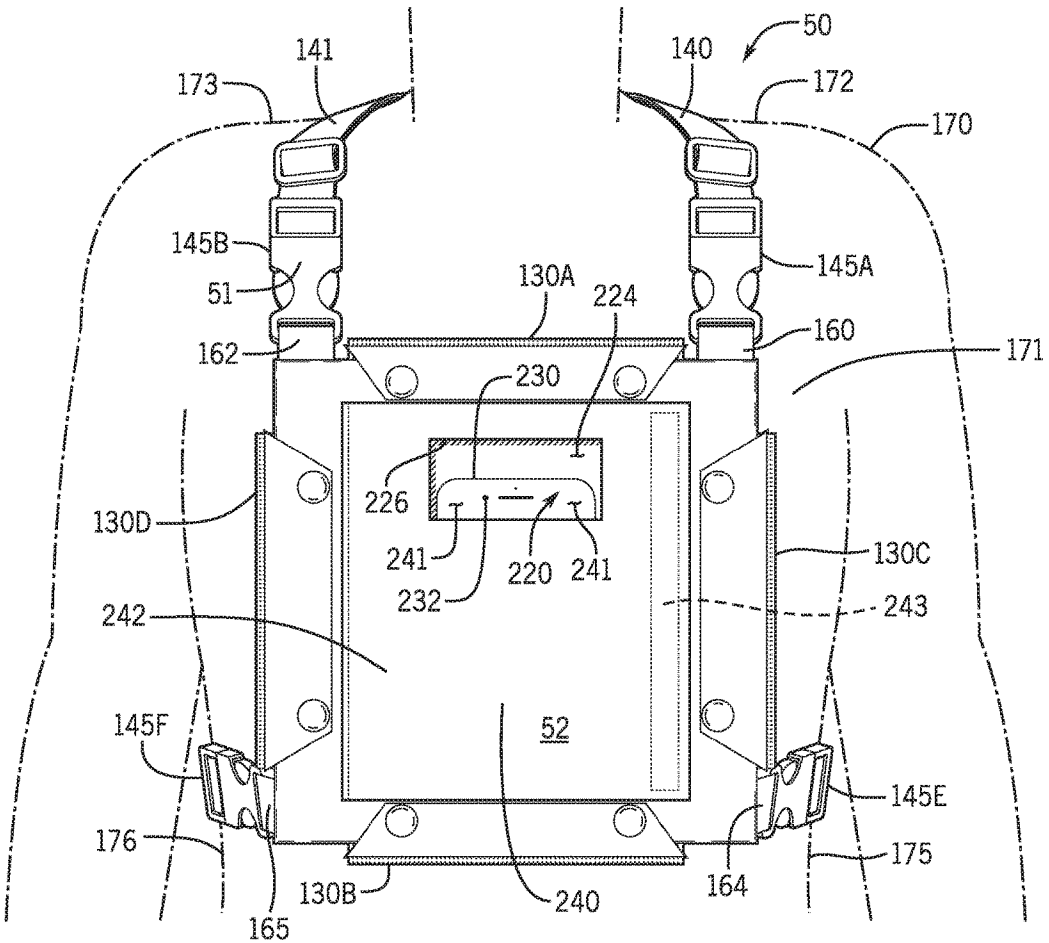
FIG. 6 is a front elevation view of the embodiment of FIG. 1 shown as it would appear being worn.
Figure 7:
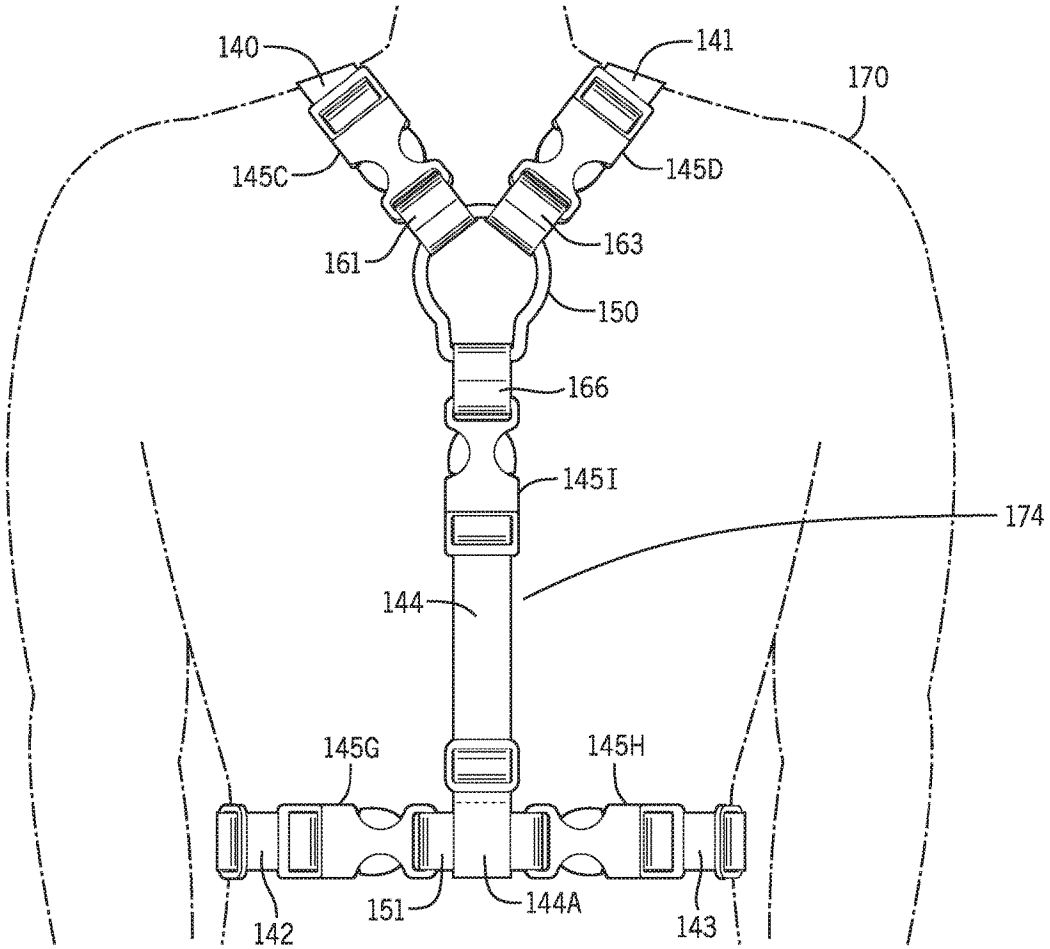
FIG. 7 is a rear elevation view corresponding to FIG. 6.

Referring in relevant part to FIGS. 6 and 7, outer side 71 of base 60 is positioned against chest 171 of the upper torso of human wearer 170, represented here as an adult human male as a matter of illustration and reference, left shoulder strap 140 extends over left shoulder 172 of wearer 170 from base 60 to tie-down ring 150 centered along the upper part of back 174 of wearer 170, right shoulder strap 141 extends over right shoulder 173 of wearer 170 from base 60 to tie-down ring 150 centered along the upper part of back 174 of wearer 170, left waist strap 142 extends over left waist 175 of wearer 170 from base 60 to connecting strap 151 centered along the lower part of back 174 of wearer 170, right waist strap 143 extends over right waist 176 of wearer 170 from base 60 to connecting strap 151 centered along the lower part of back 174 of wearer 170, and back strap 144 extends downwardly along the center of back 174 of wearer 170 from tie-down ring 150 to connecting strap 151, when harness 51 is worn by wearer 170. Male and female buckle members 146 and 147 of the respective buckles 145 can be selectively de-united and united to enable wearer 170 to put on harness 51. The lengths of straps 140-144 can be length-adjusted as needed in order to fit harness 51 snugly/closely to wearer 170, especially on the outside of the wearer's garment(s).

§ II. The Pack

Referring now in relevant part to FIGS. 1 and 3, pack 52 includes base 200, which, like base 60, is flat and generally square in overall shape and coextensive with respect to base 60. Base 200 is a panel assembly including, as seen in FIGS. 10-12, panel 201 covered with outer layering 202 consisting of one or more layers of material. Panel 201 is fashioned of plastic, wood, metal, or other material or combination of materials having an inherently stiff material characteristic, being inherently rigid or firm and resistant to bending. Outer layering 202 is fashioned of leather, tightly woven nylon, canvas, or other material or combination of materials having the inherent properties of flexibility, resilience, tear-resistance, and ruggedness. Panel 201 is upholstered with outer layering 202, which encloses panel 201 and defines the major sides and peripheral edge of base 200 as described below.

Referring in relevant part to FIGS. 1 and 3, base 200 includes inner side 210 and opposed outer side 211, and peripheral edge 212 defined by first end edge 213 and opposed second end edge 214, and first side edge 215 and opposed second side edge 216 that extend from first end edge 213 to second end edge 214. First and second end edges 213 and 214 are parallel with respect to each other, and first and second side edges 215 and 216 are parallel with respect to each other and are orthogonal with respect to first and second end edges 213 and 214. Base 200 has a length from first end edge 213 to second end edge 214 and a width from first side edge 215 to second side edge 216, and the length of base 200 and the width of base 200 are substantially the same as the length of base 60 and the width of base 60, characterizing the generally square shape of base 200. However, as noted above, in some embodiments, the base 200 may instead be rectangular in shape (e.g., where the length of the base 200 and the width of the base 200 are different).

Figure 4:
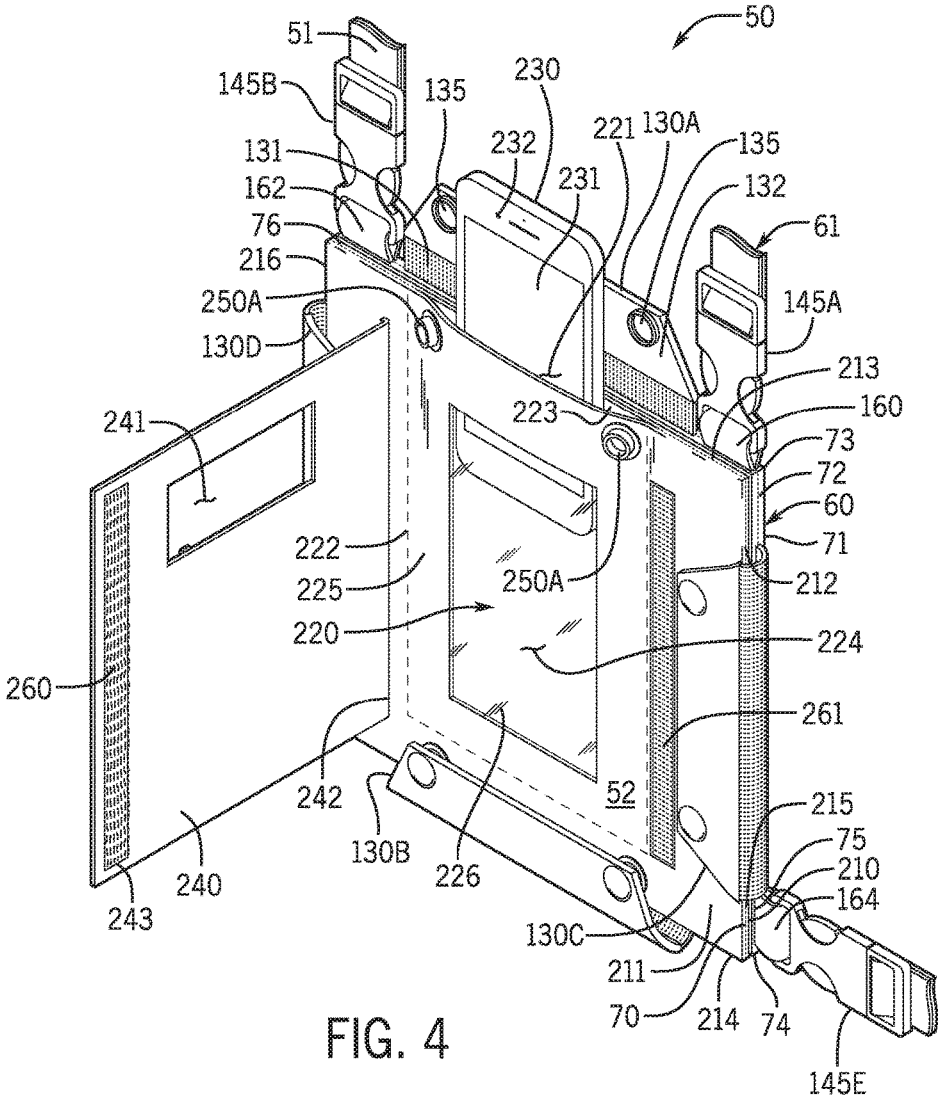
FIG. 4 is a front perspective view illustrating a door of the pack in an open position and revealing a windowed pocket of the pack, illustrating the base in a partially opened position opening an opening of the pack to the windowed pocket, and a mobile device as it would appear partially inserted into the windowed pocket through the opening, the mobile device including a touchscreen and a camera.
Figure 5:
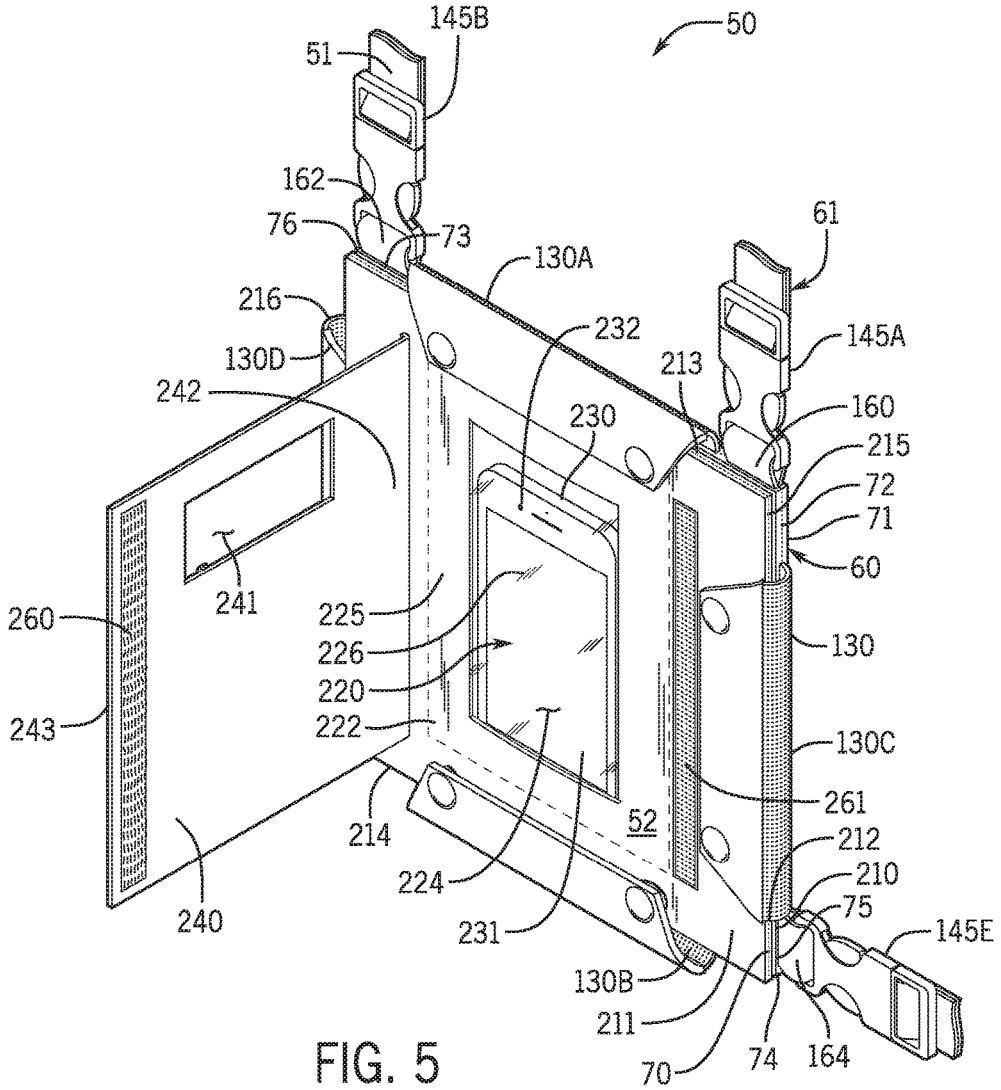
FIG. 5 is a front perspective view corresponding to FIG. 4 illustrating the base in its closed position, and illustrating the mobile device inserted into the windowed pocket with the touchscreen and the camera juxtaposed with the windowed pocket to enable the viewing and the touching of the touchscreen and the taking of pictures and video with the camera from the windowed pocket in the operation of the mobile device from the windowed pocket.

In FIGS. 4 and 5, pack 52 is formed with windowed pocket 220, and pocket inlet 221 to windowed pocket 220. Windowed pocket 220 is formed in outer side 211, and is for receiving mobile device 230, having touchscreen 231 and camera 232, through pocket inlet 221 to windowed pocket 220 so as to juxtapose touchscreen 231 and the camera 232 with windowed pocket 220 to enable the viewing and the touching of touchscreen 231 and the taking of pictures and video with camera 232 in the operation of the mobile device 230 from windowed pocket 220, when mobile device 230 is inserted into windowed pocket 220 (as shown in FIG. 5) through pocket inlet 221 (as shown in FIG. 4).

Windowed pocket 220 is formed in outer side 211 by a pair of outer and inner pocket panels of outer layering 202, including outer or first pocket panel 222 and inner or second pocket panel 223. First pocket panel 222 is superimposed atop, and is coextensive with respect to, second pocket panel 223. First and second pocket panels 222 and 223 are joined along their three edges at or adjacent to second end edge 214 and first and second side edges 215 and 216 of peripheral edge 212 of pack 52 and partially along their fourth edges at first end edge 213 of peripheral edge 212 of pack 52 so as to form pocket inlet 221 in or adjacent to first end edge 213. First and second pocket panels 222 and 223 are further joined along three sides to form the inside closed portion of windowed pocket 220 which extends into outer side 211 from pocket inlet 221 through first end edge 213 of peripheral edge 212. First and second pocket panels 222 and 223 are joined together with stitching, adhesive, heat bonding, or the like. Windowed pocket 220 is accessible through pocket inlet 221.

In FIG. 4, pocket inlet 221 to windowed pocket 220 is formed in first end edge 213 of peripheral edge 212. Pocket inlet 221 is centered or otherwise equidistant between first and second side edges 215 and 216. Windowed pocket 220 extends downwardly from pocket inlet 221 to proximate to second end edge 214, and is equidistant between first and second side edges 215 and 216. First pocket panel 222 of windowed pocket 220 includes window 224 framed by a peripheral edge border or frame 225 of outer side 211. Window 224 is fitted with a thin sheet 226 of transparent material. Sheet 226 is thin in that it has a thickness of approximately 0.2-0.3 millimeters, and is formed of transparent flexible plastic that is affixed to and held by border 225, such as by heat bonding, an adhesive, stitching, or the like.

Figure 8:
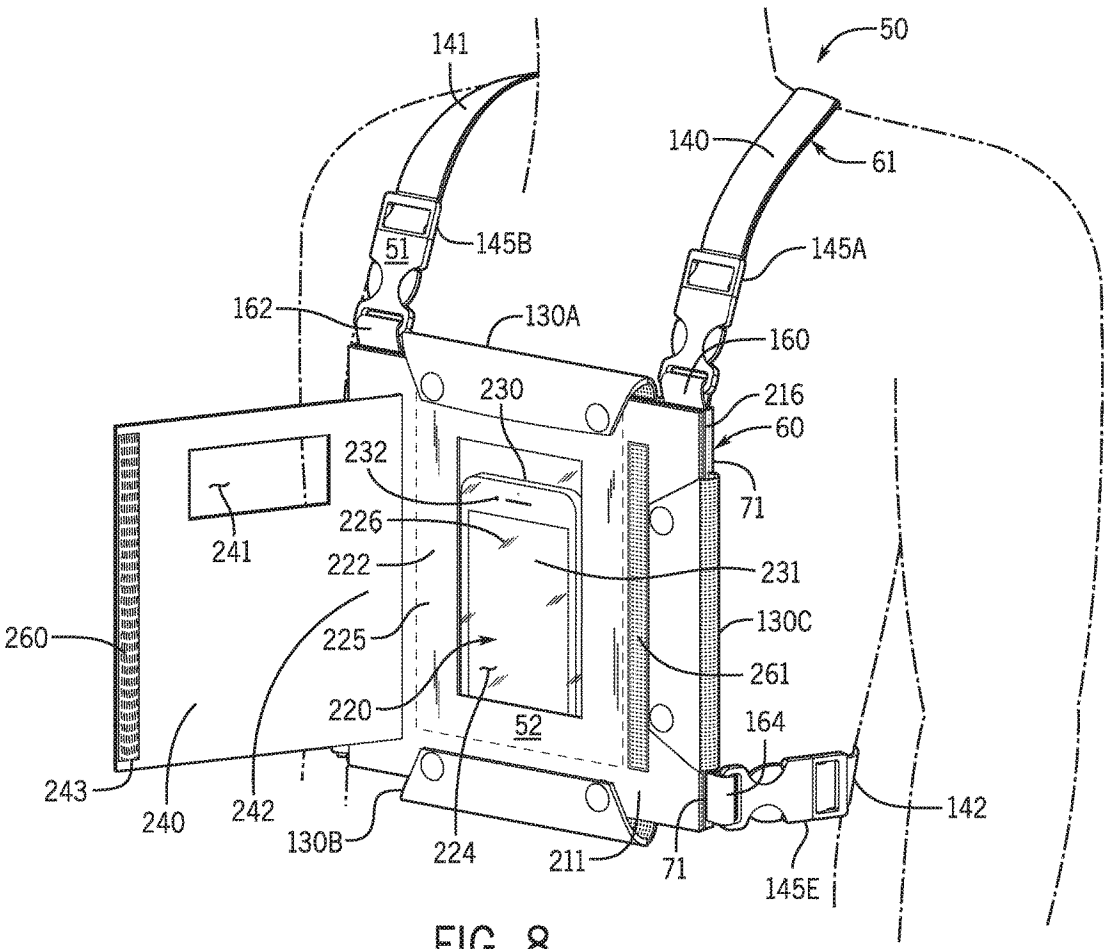
FIG. 8 is a front perspective view corresponding to FIGS. 6 and 7, illustrating the mobile device inserted into the windowed pocket with the touchscreen and the camera juxtaposed with the windowed pocket to enable the viewing and the touching of the touchscreen and the taking of pictures and video with the camera from the windowed pocket in the operation of the mobile device from the windowed pocket, when the door is in its open position relative to the windowed pocket.

Base 200 further includes a door 240. Door 240, like outer layering 202, is fashioned of leather, tightly woven nylon, canvas, or other material or combination of materials having the inherent properties of flexibility, resilience, tear-resistance, and ruggedness. Door 240 is flat and generally square in shape, is formed with window 241, is centered inboard of peripheral edge 212 and includes proximal extremity 242 mounted to outer pocket panel 222 of outer side 211 between second side edge 216 and windowed pocket 220, and an opposed distal extremity 243. Proximal extremity 242 is mounted to first pocket panel 222 of outer side 211 with stitching, heat bonding, adhesive, or the like. The inherent material characteristics of door 240 enables door 240 to pivot at proximal extremity 242 between an open position away from windowed pocket 220 in FIGS. 4, 5, and 8, and a closed position over windowed pocket 220 in FIGS. 1, 2, and 6. Door 240 covers windowed pocket 220 and window 241 of door 240 is juxtaposed with a portion of windowed pocket 220, when door 240 is in the closed position. Furthermore, door 240 covers windowed pocket 220 over touchscreen 231 of mobile device 230 and window 241 of door 240 and windowed pocket 220 are juxtaposed enabling the taking of pictures and video with camera 232 from window 241 of door 240 and windowed pocket 220, when door 240 is in the closed position, when the mobile device 230 is received in windowed pocket 220, and when touchscreen 231 and camera 232 are juxtaposed with windowed pocket 220.

In FIG. 3, first pocket panel 222 of outer side 211 is formed with complemental engagement or fastener elements 250, including complemental fastener elements 250A near first end edge 213 that are registered with the respective fastener elements 135 of flap 130A, complemental fastener elements 250B near second end edge 214 that are registered with the respective fastener elements 135 of flap 130B, complemental fastener elements 250C near first side edge 215 that are registered with the respective fastener elements 135 of flap 130C, and complemental fastener elements 250D near second side edge 216 that are registered with the respective fastener elements 135 of flap 130D. Complemental fastener elements 250 encircle windowed pocket 220, are between door 240 and peripheral edge 212, and encircle door 240 when door 240 is in its closed position. In this embodiment, fastener elements 135 of flaps 130 are female snap elements, and complemental fastener elements 250 are male snap elements, wherein each corresponding pair of fastener and complemental fastener elements is a snap fastener. The positioning of the fastener and complemental fastener elements 135 and 250 can be reversed in an alternate embodiment.

Door 240 and outer pocket panel 222 of outer side 211 of pack 52 incorporate a latch assembly for releasably securing door 240 to pack when door 240 is in its closed position, and which enables door 240 to be repeatedly opened and closed. As shown in FIG. 4, the latch assembly includes a hook and loop fastener having an element 260 thereof carried by distal extremity 243 of door 240, and a complemental element 261 thereof carried by first pocket panel 222 of outer side 211 of pack 52 between windowed pocket 220 and complemental fasteners elements 250 corresponding to flap 130C. In this embodiment, element 260 is the hook element and element 261 is the loop element. This arrangement can be reversed without departing from the invention. In alternate embodiments, the latch assembly can include snap fasteners, a zipper fastener, etc.

To employ pack 52 with mobile device 230 in FIGS. 4 and 5, mobile device 230 is taken up, such as by hand, and applied upright into windowed pocket 220 through pocket inlet 221 in FIG. 4 so as to juxtapose touchscreen 231 and camera 232 with windowed pocket 220 in FIG. 5 to enable the viewing and the touching of touchscreen 231 and the taking of still pictures and video with camera 232 in the operation of mobile device 230 via sheet 226 of transparent material of windowed pocket 220. The shape of windowed pocket 220 corresponds to the shape of mobile device 230 to ensure mobile device 230 is held snugly by windowed pocket 220. Again, mobile device 230 is oriented in place in windowed pocket 220 in an operative position so as to juxtapose touchscreen 231 and camera 232 with windowed pocket 220 to enable the viewing and touching of touchscreen 231 and the taking of pictures and video in the operation of mobile device 230 via sheet 226 of transparent material.

§ III. The Pack Assembly

Pack 52 is configured or otherwise adapted to be coupled to, and carried by, base 60 of harness 51. Base 60 of harness 51 is in an open position in FIG. 3 when pack 52 is detached from base 60 and when flaps 130 extend from peripheral edge 72 and fastener elements 135 are detached from complemental fastener elements 250 of pack 52. Referring in relevant part to FIGS. 3 and 5, to attach pack 52 to base 60 from the open position of base 60, inner side 210 of pack 52 is superimposed atop inner side 70 of base 60 positioning upper and lower inner sleeves 82 and 83 between inner side 210 of pack 52 and inner side 70 of base 60 and so as to juxtapose first end edge 213 of pack 52 with first end edge 73 of base 60, so as to juxtapose second end edge 214 of pack 52 with second end edge 74 of base 60, so as to juxtapose first side edge 215 of pack 52 with first side edge 75 of base 60, and so as to juxtapose second side edge 216 of pack 52 with second side edge 76 of base 60. After so positioning pack 52 on base 60, in which base 60 and pack 52 are axially aligned, base 60 is closed to releasably couple pack 52 to base 60. To close base 60 to releasably couple pack 52 to base 60 of harness 51, flap 130A is folded over first end edge 213 of pack 52 over pocket inlet 221 to windowed pocket 220 from first end edge 73 of base 60 to outer side 211 of pack 52 outboard of windowed pocket 220 and fasteners 135 of flap 130A and corresponding complemental fasteners 250A are snapped together releasably securing flap 130A to pack 52, flap 130B is folded over second end edge 214 of pack 52 from second end edge 74 of base 60 to outer side 211 of pack 52 outboard of windowed pocket 220 and fasteners 135 of flap 130B and corresponding complemental fasteners 250B are snapped together releasably securing flap 130B to pack 52, flap 130C is folded over first side edge 215 of pack 52 from first side edge 75 of base 60 to outer side 211 of pack 52 outboard of windowed pocket 220 and fasteners 135 of flap 130C and corresponding complemental fasteners 250C are snapped together releasably securing flap 130C to pack 52, and flap 130D is folded over second side edge 216 of pack 52 from second side edge 76 of base 60 to outer side 211 of pack 52 outboard of windowed pocket 220 and fasteners 135 of flap 130D and corresponding complemental fasteners 250D are snapped together releasably securing flap 130D to pack 52. The inherent flexible and elastic material characteristics of proximal parts 131 of flaps 130 enables flaps 130 to be so folded. And so when base 60 of harness 51 is closed relative to pack 52 and pack 52 is coupled releasably to base 60 and mobile device 230 is applied to windowed pocket 220, flap 130A extends over first end edge 213 of pack 52 over pocket inlet 221 to windowed pocket 220 from first end edge 73 of base 60 to outer side 211 of pack 52 outboard of windowed pocket 220 and fasteners 135 of flap 130A and corresponding complemental fasteners 250A are snapped together releasably securing flap 130A to pack 52 and flap 130A extends completely over and closes pocket inlet 221 to windowed pocket 220 in response entrapping mobile device 230 in windowed pocket 220, as shown in FIG. 5, flap 130B extends over second end edge 214 of pack 52 from second end edge 74 of base 60 to outer side 211 of pack 52 outboard of windowed pocket 220 and fasteners 135 of flap 130B and corresponding complemental fasteners 250B are snapped together releasably securing flap 130B to pack 52, flap 130C extends over first side edge 215 of pack 52 from first side edge 75 of base 60 to outer side 211 of pack 52 outboard of windowed pocket 220 and fasteners 135 of flap 130C and corresponding complemental fasteners 250C are snapped together releasably securing flap 130C to pack 52, and flap 130D extends over second side edge 216 of pack 52 from second side edge 76 of base 60 to outer side 211 of pack 52 outboard of windowed pocket 220 and fasteners 135 of flap 130D and corresponding complemental fasteners 250D are snapped together releasably securing flap 130D to pack 52. To detach pack 52 from base 60, the foregoing pack 52 installation method need only be reversed. Pack 52 can be so repeatedly attached and detached relative to base 60. In an alternate embodiment, pocket opening 221 can be fashioned with a dedicated closure, such as a snap closure, a zipper closure, a hook-and-loop closure, etc., useful for opening and closing pocket inlet 221 independently of flap 130A.

Flaps 130 can be opened and closed independently from one another. As a matter of example, in FIG. 4 flaps 130B-130D are shown as they would appear closed releasably securing pack 52 to base 60 of harness 51, whereas flap 130A is shown as it would appear open thereby opening the pocket inlet 221 to windowed pocket 220 to enable mobile device 230 to be selectively inserted into windowed pocket 220 through pocket inlet 221 and selectively withdrawn from windowed pocket 220 through pocket inlet 221, according to the principle of the invention.

When mobile device 230 is inserted into windowed pocket 220 and pack 52 is coupled removably to base 60 of harness 51 and door 240 is secured in its closed position in FIG. 1, pack assembly 50 is ready for use to employ mobile device 230 usefully as a body camera for taking still pictures and video with camera 232 for recording the wearer's interactions with the environment and others, according to the principle of the invention. Base 60 of harness 51 is configured to be positioned against the chest of the upper torso of the wearer for holding pack 52 ahead of the chest of the upper torso of the wearer with windowed pocket 220 facing outwardly relative to the chest of the upper torso of the wearer, when harness 51 is worn by the upper torso of the wearer in FIGS. 6 and 8. Referring again in relevant part to FIGS. 6-8, inner side 70 of base 60 positioned against chest 171 of wearer 170, left shoulder strap 140 extends over left shoulder 172 of wearer 170 from base 60 to tie-down ring 150 centered along the upper part of back 174 of wearer 170, right shoulder strap 141 extends over right shoulder 173 of wearer 170 from base 60 to tie-down ring 150 centered along the upper part of back 174 of wearer 170, left waist strap 142 extends over left waist 175 of wearer 170 from base 60 to connecting strap 151 centered along the lower part of back 174 of wearer 170, right waist strap 143 extends over right waist 176 of wearer 170 from base 60 to connecting strap 151 centered along the lower part of back 174 of wearer 170, and back strap 144 extends downwardly along the center of back 174 of wearer 170 from tie-down ring 150 to connecting strap 151, when harness 51 is worn by wearer 170. From this position, door 240 can be selectively opened in FIG. 8 to enable wearer 170 to view and touch touchscreen 231 and take pictures and video with camera 232 in the operation of mobile device 230 via sheet 226 of transparent material of windowed pocket 220 as a body camera for recording the wearer's interactions with the environment and others with camera 232. Furthermore, door 240 partially covers windowed pocket 220 and protects mobile device 230 applied therein and window 241 of door 240 and windowed pocket 220 are juxtaposed for enabling the use of mobile device 230 as a body camera, namely, for the taking of pictures and video with camera 232 from window 241 of door 240 and windowed pocket 220 via sheet 226 of transparent material in the operation of mobile device 230, when door 240 is in the closed position, when the mobile device 230 is received in windowed pocket 220, and when touchscreen 231 and camera 232 are juxtaposed with windowed pocket 220 in FIG. 6.

§ IV. The Inflatable Bladders

Figure 9:
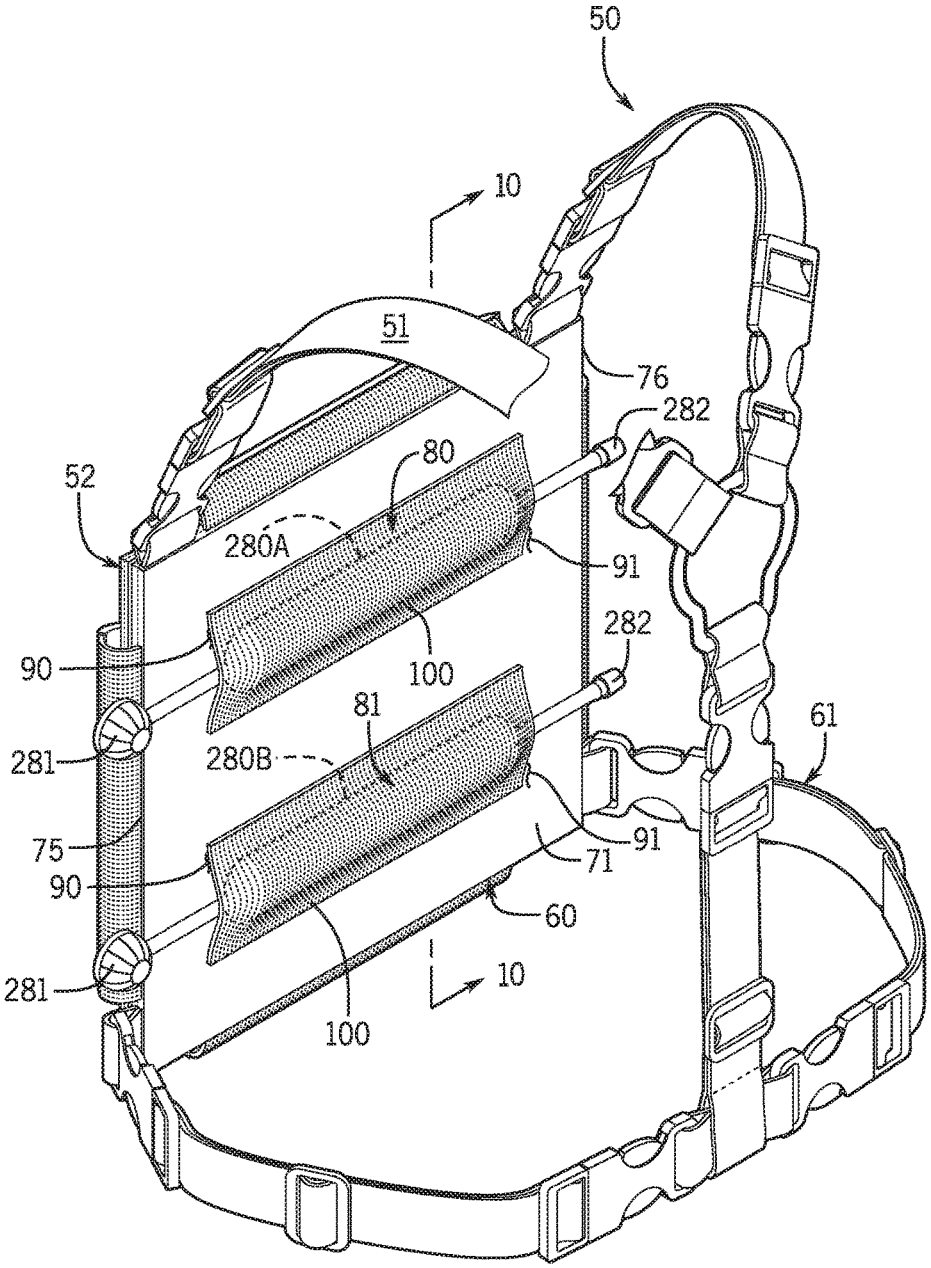
FIG. 9 is a rear perspective view corresponding to FIG. 2 illustrating upper and lower inflatable bladders inserted into the corresponding upper and lower outer sleeves.

FIG. 9 is a rear perspective view corresponding to FIG. 2 illustrating inflatable bladders 280 inserted into the respective upper and lower outer sleeves 80 and 81. Bladders 280 can be selectively inflated and deflated for selectively adjusting the field of view of camera 232 of mobile device 230 when mobile device 230 is carried by pack 52, when pack 52 is coupled to base 60 of harness 51, and when harness 51 is worn by the upper torso of the wearer 170, namely, for providing a selected up-angled or down-angled field of view of camera 232 as desired by the wearer of pack assembly 50.

Inflatable bladders 280 each include a pump 281 and a release valve 282. Pumps 281, operable by hand, are used to inflate the respective inflatable bladders 280. Release valves 282, operable by hand, are used to deflate the respective inflatable bladders 280.

In FIGS. 9 and 10, inflatable bladder 280A is inserted into, and is held by, upper outer sleeve 80, through one of its first and second open ends 90 and 91, in which inflatable bladder 280A extends outwardly from open end 90 to pump 281 outboard of first side edge 75 of base 60, and extends outwardly from open end 91 to release valve 282 outboard of second side edge 76 of base 60. The inherent elasticity of strap 100 of upper outer sleeve 80 enables inflatable bladder 280A to be advanced into upper outer sleeve 80 through either one of its first and second open ends 90 and 91 and held in place against outer side 71 by strap 100, and withdrawn from either one of its first and second open ends 90 and 91. Inflatable bladder 280B is inserted into, and is held by, lower outer sleeve 81, through one of its first and second open ends 90 and 91, in which inflatable bladder 280B extends outwardly from open end 90 to pump 281 outboard of first side edge 75 of base 60, and extends outwardly from open end 91 to release valve 282 outboard of second side edge 76 of base 60. The inherent elasticity of strap 100 of lower outer sleeve 81 enables inflatable bladder 280B to be advanced into lower outer sleeve 81 through either one of its first and second open ends 90 and 91 and held in place against outer side 71 by strap 100, and withdrawn from either one of its first and second open ends 90 and 91.

In FIGS. 9 and 10, inflatable bladders 280 are inflated in the respective upper and lower outer sleeves 80 and 81. In FIG. 11, inflatable bladder 280A is inflated in upper outer sleeve 80 and inflatable bladder 280B is deflated in lower outer sleeve 81. In FIG. 12, inflatable bladder 280A is deflated in upper outer sleeve 80 and inflatable bladder 280B is inflated in lower outer sleeve 81. When inflatable bladder 280A is inflated in upper outer sleeve 80 in FIGS. 9, 10, and 11, strap 100 of upper outer sleeve 80 elastically extends. When inflatable bladder 280A is deflated in upper outer sleeve 80 in FIG. 12, strap 100 of upper outer sleeve 80 elastically constricts. When inflatable bladder 280B is inflated in lower outer sleeve 81 in FIGS. 9, 10, and 12, strap 100 of lower outer sleeve 81 elastically extends. When inflatable bladder 280B is deflated in lower outer sleeve 81 in FIG. 11, strap 100 of upper outer sleeve 80 elastically constricts.

Inflatable bladders 280A and 280B interact between chest 171 of wearer 170 concurrently holding base 60 and pack 52 and mobile device 230 held by pack 52 parallel relative to chest 171 of wearer 170 in FIG. 10 when inflatable bladders 280 are inflated in the respective upper and lower outer sleeves 80 and 81, when mobile device 230 is carried by pack 52, when pack 52 is coupled to base 60 of harness 51, and when harness 51 is worn by the upper torso of the wearer 170, so as to provide a normal field of view of camera 232 as desired by the wearer of pack assembly 50. Inflatable bladder 280A interacts between chest 171 of wearer 170 concurrently holding tipping/tilting base 60 and pack 52 and mobile device 230 held by pack 52 downwardly relative to chest 171 of wearer 170 in FIG. 11 when inflatable bladder 280A is inflated in upper outer sleeve 80 and when inflatable bladder 280B is deflated in lower outer sleeve 81, when mobile device 230 is carried by pack 52, when pack 52 is coupled to base 60 of harness 51, and when harness 51 is worn by the upper torso of the wearer 170, so as to provide a down-angled field of view of camera 232 as desired by the wearer of pack assembly 50. Inflatable bladder 280B interacts between chest 171 of wearer 170 concurrently holding tipping/tilting base 60 and pack 52 and mobile device 230 held by pack 52 upwardly relative to chest 171 of wearer 170 in FIG. 12 when inflatable bladder 280B is inflated in lower outer sleeve 81 and when inflatable bladder 280A is deflated in upper outer sleeve 80, when mobile device 230 is carried by pack 52, when pack 52 is coupled to base 60 of harness 51, and when harness 51 is worn by the upper torso of the wearer 170, so as to provide an up-angled field of view of camera 232 as desired by the wearer of pack assembly 50. Accordingly, inflatable bladders 280A and 280B can be selectively inflated, partially inflated, and deflated in upper and lower outer sleeves 80 and 81, respectively, for selectively tipping/tilting mobile device 230 upwardly and downwardly for concurrently defining a selected field of view of camera 232 relative to chest 171 of wearer 170. Additionally, in some embodiments, inflatable bladders 280 can be inserted into respective upper and lower sleeves 82 and 83 on inner side 70 of base 60. Furthermore, in some embodiments, other spacer elements can be in place of inflatable bladders 280.

§ V. Alternative Embodiment of Wearable Pack Assembly for Torso

Figure 13:
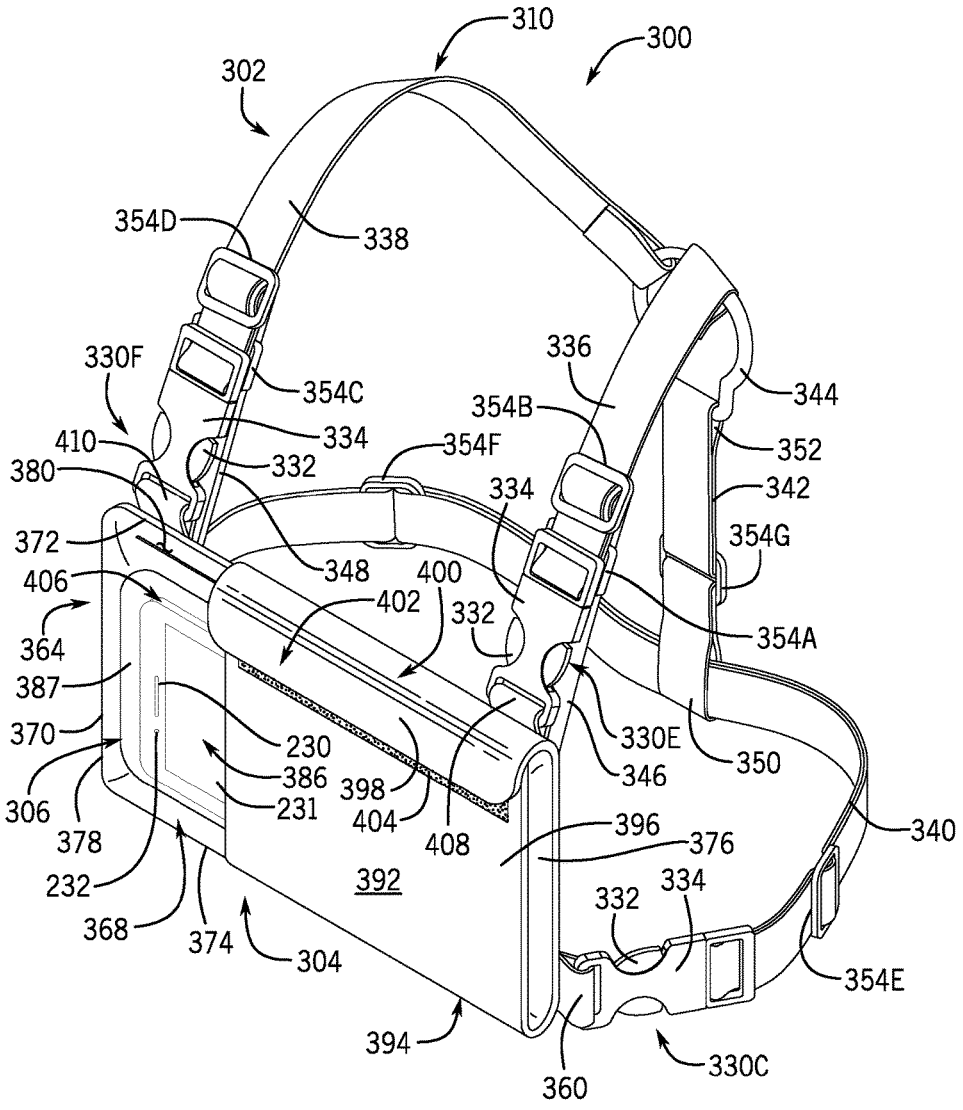
FIG. 13 is a front perspective view of a wearable pack assembly for a mobile device according to another embodiment, the wearable pack assembly includes a harness having a base, and a pack carried by a base.
Figure 14:
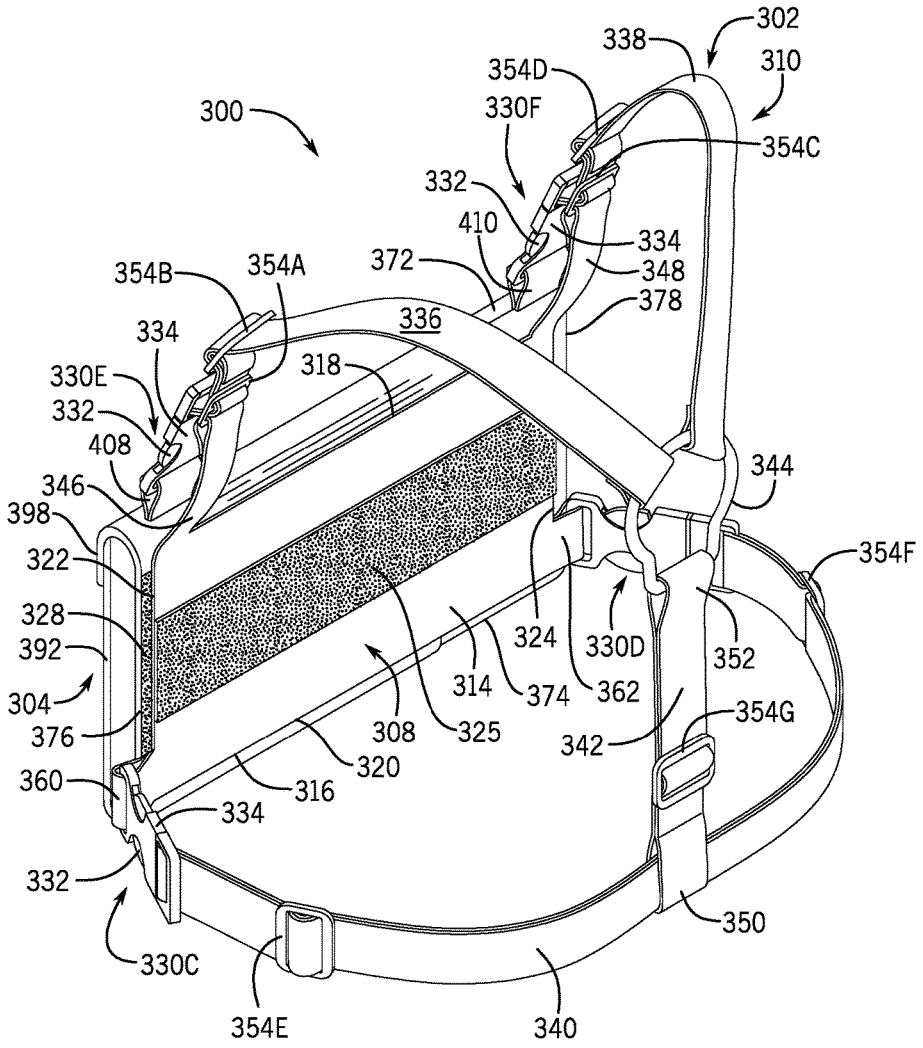
FIG. 14 is rear perspective view of the pack of FIG. 13.

FIGS. 13-24 illustrate a wearable pack assembly 300 for a mobile device according to another embodiment. Pack assembly 300 includes a harness 302 and a pack 304. Harness 302 is wearable, and pack 304 is configured to be carried by harness 302, as shown in FIGS. 13 and 14. Generally, pack 304 includes a windowed pocket 306 for receiving a mobile device through an opening to windowed pocket 306 so as to juxtapose a touchscreen and a camera of the mobile device with the windowed pocket 306 to enable the viewing and the touching of the touchscreen and the taking of pictures and video with the camera in the operation of the mobile device from windowed pocket 306. Harness 302 is configured to hold pack 304 ahead of a chest of an upper torso of a wearer with windowed pocket 306 facing outwardly relative to the chest of the upper torso of the wearer when harness 302 is worn by the upper torso of the wearer and when pack 304 is carried by harness 302 for enabling the wearer to usefully employ the camera of the mobile device as a body camera for recording a wearer's interactions with the environment when the mobile device is carried operatively by the pack 304.

Figure 15:
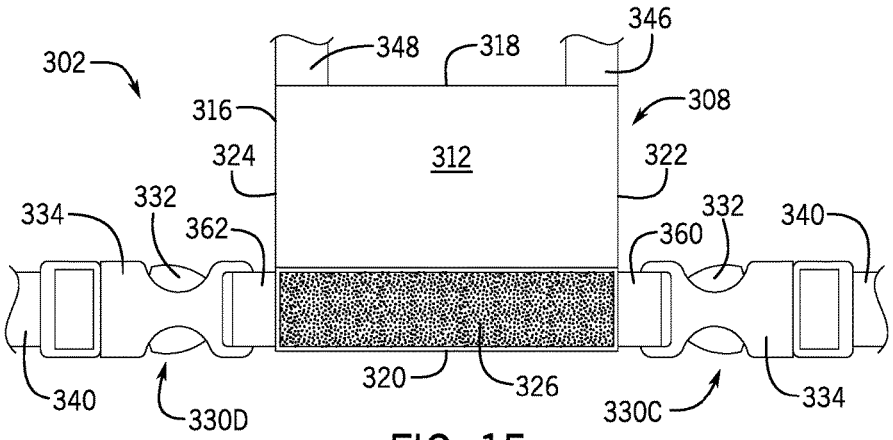
FIG. 15 is a front partial elevation view of the harness including the base of FIG. 13.

With respect to the harness 302, referring to FIGS. 13-15, the harness 302 can include a base 308 and strap assembly or system 310. The base 308 can be flat and generally rectangular in overall shape. In some embodiments, the base 308 is a panel assembly including a panel covered with outer layering consisting of one or more layers of material, similar to that described above with respect to base 60 of FIGS. 1-12. For example, panel is upholstered with outer layering, which encloses panel and defines the major sides and peripheral edge of base 308, as described below.

Referring in relevant part to FIGS. 13-15, base 308 can include inner side 312 and opposed outer side 314, and peripheral edge 316. As shown in FIG. 15, peripheral edge 316 can be defined by first end edge 318 and opposed second end edge 320, and first side edge 322 and opposed second side edge 324 that extend from the first end edge 318 to second end edge 320. First and second end edges 318 and 320 are parallel with respect to each other, and first and second side edges 322 and 324 are parallel with respect to each other and are orthogonal with respect to first and second end edges 318 and 320. Base 308 therefore has a length from first end edge 318 to second end edge 320 and a width from first side edge 322 to second side edge 324. As shown, the length of base 308 can be shorter than the width of base 308, characterizing the generally rectangular shape of base 308. However, in some embodiments, base 308 may instead be square in shape (e.g., where the length of the base 308 and the width of the base 308 are equal).

FIG. 14 illustrates an engagement mechanism on outer side 314. For example, the engagement mechanism can be configured to engage spacers, as further described below. In one embodiment, the engagement mechanism is a hook and loop fastener 325. More specifically, as shown in FIG. 14, an elongate strip of hook and loop fastener 325 can be applied across outer side 314, from first side edge 322 to second side edge 324 and configured to engage mating hook and loop fastener on a spacer (as further described below). However, in other embodiments, a plurality of smaller strips or squares of hook and loop fastener can be positioned along the outer side 314. Furthermore, in other embodiments, other engagement mechanisms may be contemplated.

Figure 18:
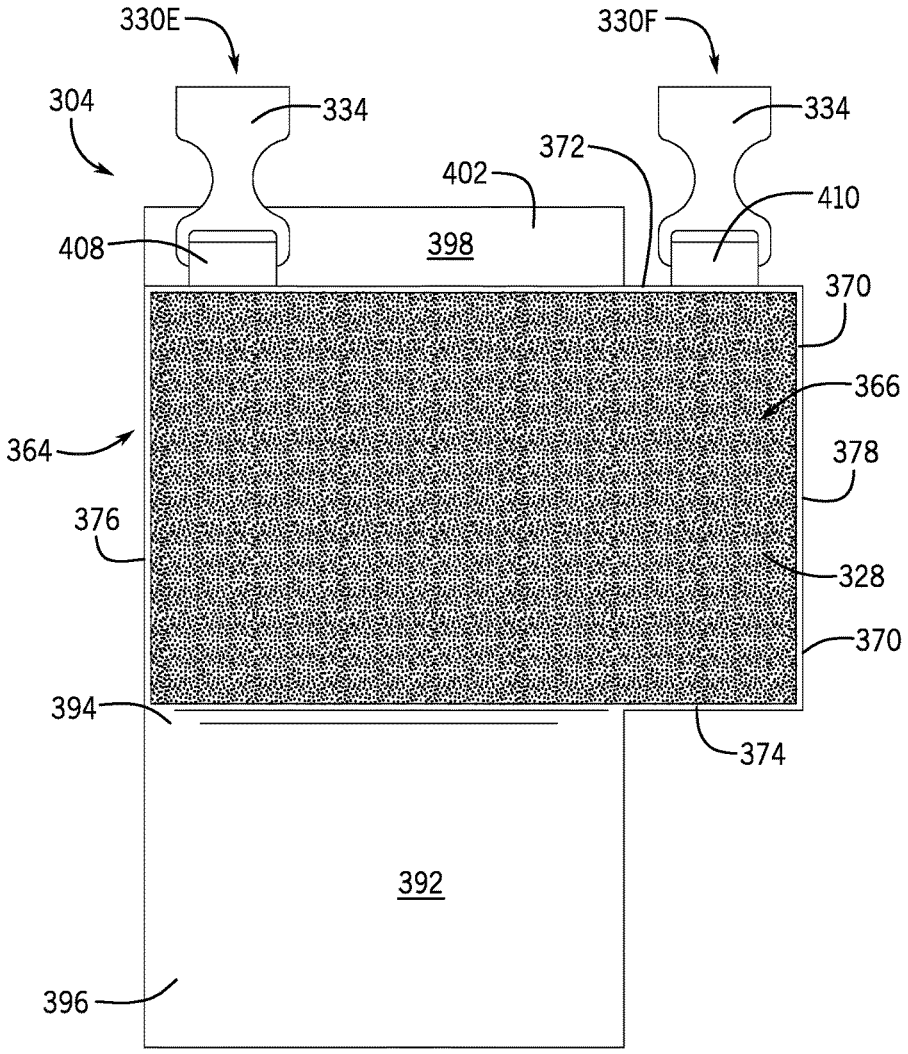
FIG. 18 is a rear elevational view of the pack of FIG. 16 in its open position.

Additionally, pack assembly 300 includes an engagement assembly for removably coupling pack 304 to base 308. For example, the engagement assembly includes a hook and loop fastener 326 on the inner side 312 of the base 308, as shown in FIG. 15, configured to engage a mating hook and loop fastener 328 on the pack 304, as shown in FIG. 18 and further described below. In alternate embodiments, the hook and loop fasteners 326, 328 can be button fasteners, snap fasteners, or other suitable fastening elements. Additionally, the engagement assembly can include buckles 330, similar to buckles 145 described above. For example, harness 302 can include male buckle members 332 and pack 304 can include female buckle members 334 configured to engage the male buckle members 332 of harness 302, as further described below, to removably couple pack 304 to harness 302.

In FIGS. 13-14, strap assembly 310 is connected to base 308, is used to strap base 308 to the upper torso of the wearer, and includes left and right shoulder straps 336 and 338, a waist strap 340, and a back strap 342 interconnected with buckles 330, connecting straps 346-348, 360-362, and a tie-down ring 344. Generally, tie-down ring 344 is configured to connect left shoulder strap 336, right shoulder strap 338, and back strap 342, and back strap 342 is further coupled to waist strap 340. Straps 336-342, 346-348, 360-362 are each fashioned of leather, tightly woven nylon, canvas, elastic material, or other material or combination of materials having the properties of flexibility, resilience, tear-resistance, and ruggedness, and are conventionally length-adjustable straps. Additionally, different straps can incorporate different materials. For example, in some embodiments, one or more of straps 336-342 are fashioned of an elastic material, while one or more of straps 346-348, 360-362 are fashioned of a non-elastic webbing material. Each buckle 330 is a conventional slide release buckle including a male buckle member 332, the hook end, and a female buckle member 334, the catch end, as described above. However, other buckles or fastening mechanisms may be used in other embodiments.

Generally, as shown in FIG. 14, left and right shoulder straps 336 and 338 can be connected to first end edge 318 (e.g., at either end thereof) via left and right connecting straps 346, 348, and extend rearwardly therefrom to tie-down ring 344. Waist strap 340 is connected to first side edge 322, for example, near second end edge 320, with buckle 330C, and is further connected to second side edge 324, for example, near second end edge 320 with buckle 330D. As shown in FIG. 14, waist strap 340 extends rearwardly from either side edge 322, 324 of base 308 and is routed through a first looped end 350 of back strap 342. Back strap 342 interconnects tie-down ring 344 and waist strap 340. In this embodiment, back strap 342 is looped around tie-down ring 344 at a second looped end 352, and extends downwardly therefrom to first looped end 350 through which waist strap 340 extends.

More specifically, in the present embodiment, left connecting strap 346 is attached to first end edge 318 along the left side near first side edge 322 and is coupled to (e.g., looped through) a strap adjuster 354A. Furthermore, left shoulder strap 336 is coupled to strap adjuster 354B (e.g., looped around strap adjuster 354B and attached to itself). Left shoulder strap 336 is routed from strap adjuster 354B, through strap adjuster 354A (e.g., to connect left shoulder strap 336 to left connecting strap 346), then back through strap adjuster 354B, and extends rearwardly from strap adjuster 354B to tie-down ring 344. Strap adjuster 354B can therefore be used to permit shortening or lengthening of left shoulder strap 336. As shown in FIGS. 13 and 14, left shoulder strap 336 can be coupled to tie-down ring 344 by being looped around tie-down ring 344 and attached to itself. However, in some embodiments, an additional buckle (not shown) may be used to couple left shoulder strap 336 to tie-down ring 344. Additionally, at its forward end (e.g., between strap adjuster 354A and strap adjuster 354B), left shoulder strap 336 includes a female buckle member 334 that is part of the engagement assembly described above (e.g., for coupling pack 304 to harness 302).

Right connecting strap 348 is attached to first end edge 318 along the right side, near second side edge 324, and is coupled to (e.g., looped through) a strap adjuster 354C. Furthermore, right shoulder strap 338 is coupled to strap adjuster 354D (e.g., looped around strap adjuster 354D and attached to itself). Right shoulder strap 338 is routed from strap adjuster 354D, through strap adjuster 354C (e.g., to connect right shoulder strap 338 to right connecting strap 348), then back through strap adjuster 354D, and extends rearwardly from strap adjuster 354D to tie-down ring 344. Strap adjuster 354D can therefore be used to permit shortening or lengthening of right shoulder strap 338. As shown in FIGS. 13 and 14, right shoulder strap 338 can be coupled to tie-down ring 344 by being looped around tie-down ring 344 and attached to itself. However, in some embodiments, an additional buckle (not shown) may be used to couple right shoulder strap 338 to tie-down ring 344. Additionally, at its forward end (e.g., between strap adjuster 354C and strap adjuster 354D), right shoulder strap 338 includes a female buckle member 334 that is part of the engagement assembly described above (e.g., for coupling pack 304 to harness 302).

Connecting strap 360 is attached to first side edge 322 proximate to second end edge 320, and is coupled to female buckle member 334 of buckle 330C. Male buckle member 332 of buckle 330C is coupled releasably to female buckle member 334 of buckle 330C, and waist strap 340 extends rearwardly from male buckle member 332 of buckle 330C, through first looped end 350 of back strap 342, and around to male buckle member 332 of buckle 330D. Female buckle member 334 of buckle 330D is coupled releasably to male buckle member 332 of buckle 330D, and female buckle member 334 of buckle 330D is coupled to connecting strap 362 attached to second side edge 324 proximate to second end edge 320. Additionally, waist strap 340 can include one or more strap adjusters 354E, 354F to permit shortening or lengthening of waist strap 340. While a single waist strap 340 is shown and described herein, in some embodiments, two or more waist straps 340 and, optionally, additional buckles 330 may be included. Additionally, while two buckles 330C, 330E are shown and described herein with respect to waist strap 340, in some embodiments, waist strap 340 can be interconnected with a single buckle 330.

Back strap 342 couples tie-down ring 344 to waist strap 340. More specifically, as noted above, back strap 342 is looped around tie-down ring 344 at the second looped end 352, and extends downwardly therefrom to first looped end 350, through which waist strap 340 extends. Additionally, back strap 342 can include a strap adjuster 354G to permit shortening or lengthening of back strap 342. It should be noted that any of the above-described straps can comprise multiple straps permanently coupled together or releasably coupled together via, for example, additional buckles 330. Furthermore, in some embodiments, more or less straps may be incorporated. For example, in one embodiment, the left and right shoulder straps 336, 338 can be coupled to the waist strap 340 via one or more tie-down rings 344 (e.g., without a back strap). Additionally, it should be noted that strap adjusters 354 may be positioned anywhere along straps 336-342 at positions other than what is shown in FIGS. 13 and 14.

Referring in relevant part to FIGS. 20-23, outer side 314 of base 308 is positioned against chest 171 of the upper torso of human wearer 170. Left shoulder strap 336 extends over left shoulder 172 of wearer 170 from base 308 to tie-down ring 344 centered along the upper part of back 174 of wearer 170. Right shoulder strap 338 extends over right shoulder 173 of wearer 170 from base 308 to tie-down ring 344 centered along the upper part of back 174 of wearer 170. Waist strap 340 extends over left waist 175 (or left chest) of wearer 170 from base 308, through back strap 342 centered along the lower part of back 174 of wearer 170, and over right waist 176 (or right chest) of wearer 170 to base 308. Back strap 342 extends downwardly along the center of back 174 of wearer 170 from tie-down ring 344 to waist strap 340, when harness 302 is worn by wearer 170. Male and female buckle members 332 and 334 of at least one respective buckle 330 can be selectively de-united and united to enable wearer 170 to put on harness 302. Lengths of straps 336-342 can be length-adjusted as needed (e.g., via strap adjusters 354) in order to fit harness 302 snugly/closely to wearer 170, especially on the outside of the wearer's garment(s). While waist strap 340 is generally described as extending around waist of wearer 170, waist strap 340 can extend around waist or chest of wearer 170, for example, depending on length adjustments of shoulder straps 336, 338 and back strap 342. As such, in some embodiments, waist strap 340 may alternatively be considered a chest strap.

With respect to the pack 304, referring in relevant part to FIGS. 13 and 14, pack 304 includes base 364, which, like base 308, is flat and generally rectangular in overall shape and coextensive with respect to base 308. Base 364 can be a panel assembly including a panel covered with outer layering consisting of one or more layers of material, similar to that described above with respect to base 200 of FIGS. 1-12. Panel is upholstered with outer layering, which encloses panel and defines the major sides and peripheral edge of base 364, as described below.

Referring to FIGS. 13-14 and 16-19, base 364 includes inner side 366 and opposed outer side 368, and peripheral edge 370 defined by first end edge 372 and opposed second end edge 374, and first side edge 376 and opposed second side edge 378 that extend from the first end edge 372 to second end edge 374. First and second end edges 372 and 374 are parallel with respect to each other, and first and second side edges 376 and 378 are parallel with respect to each other and are orthogonal with respect to first and second end edges 372 and 374. Base 364 therefore has a length from first end edge 372 to second end edge 374 and a width from first side edge 376 to second side edge 378. As shown, the length of base 364 can be shorter than the width of base 364, characterizing the generally rectangular shape of base 364. However, in some embodiments, base 364 may instead be square in shape (e.g., where the length of the base 364 and the width of the base 364 are equal). Generally, in some embodiments, base 364 of pack 304 can be equal in length and width to base 308 of harness 302

Figure 16:
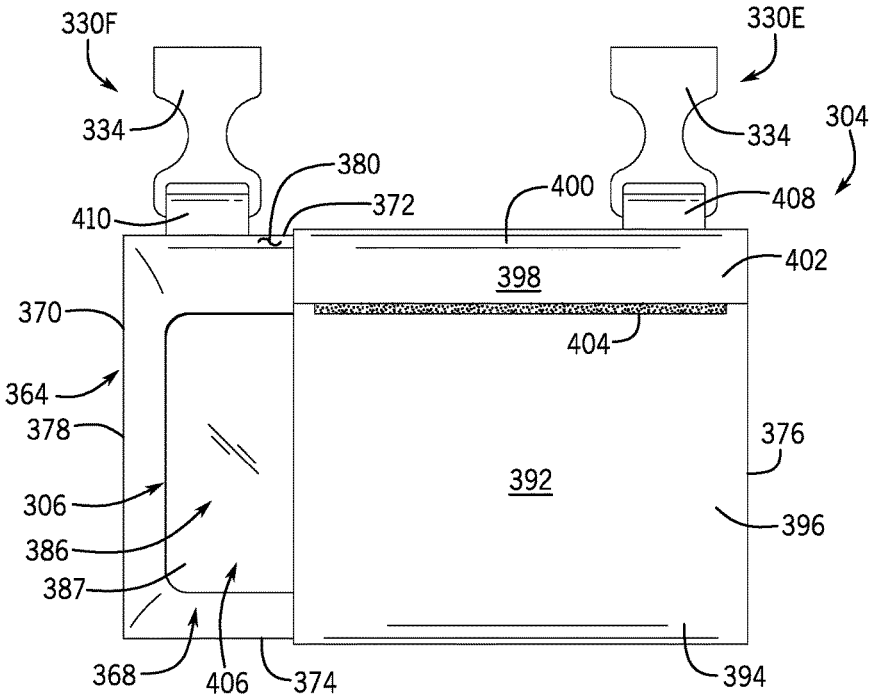
FIG. 16 is a front elevational view of the pack of FIG. 13 in its closed position, revealing a portion of a windowed pocket of the pack.
Figure 17:
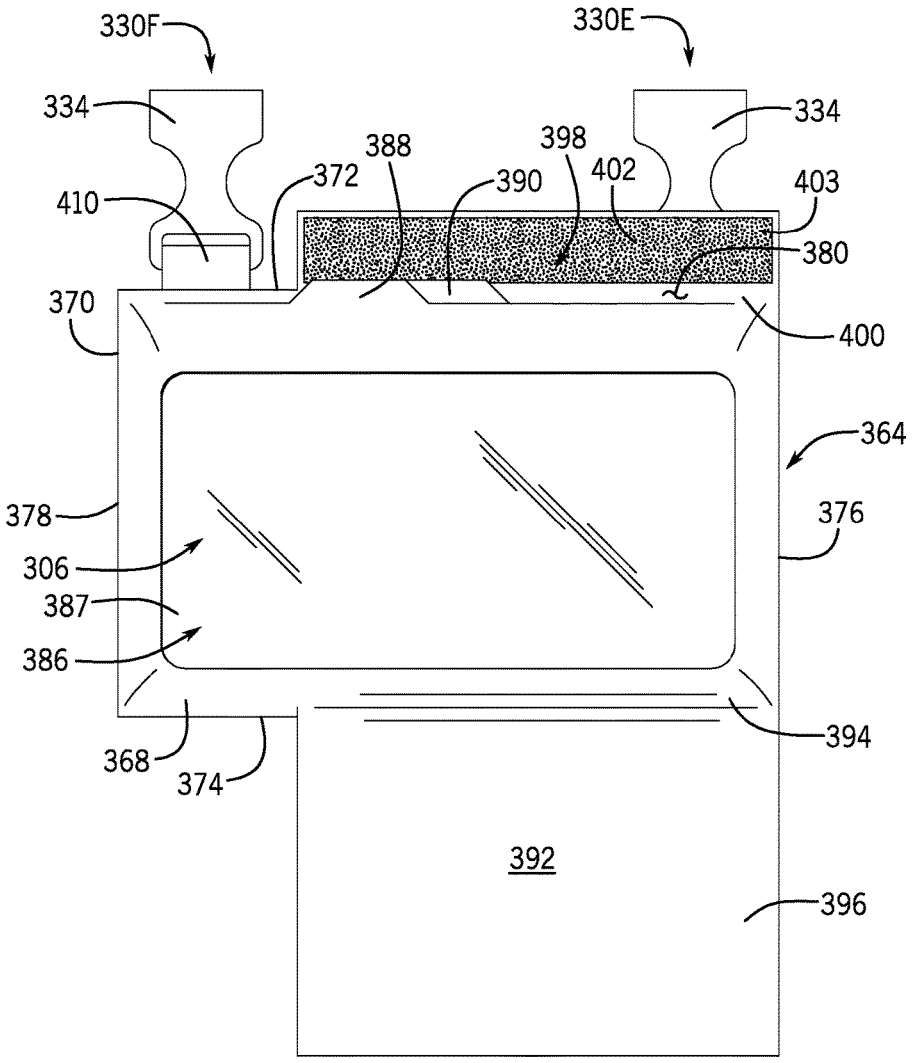
FIG. 17 is a front elevational view of the pack of FIG. 16 in its open position, revealing the windowed pocket of the pack.
Figure 22:
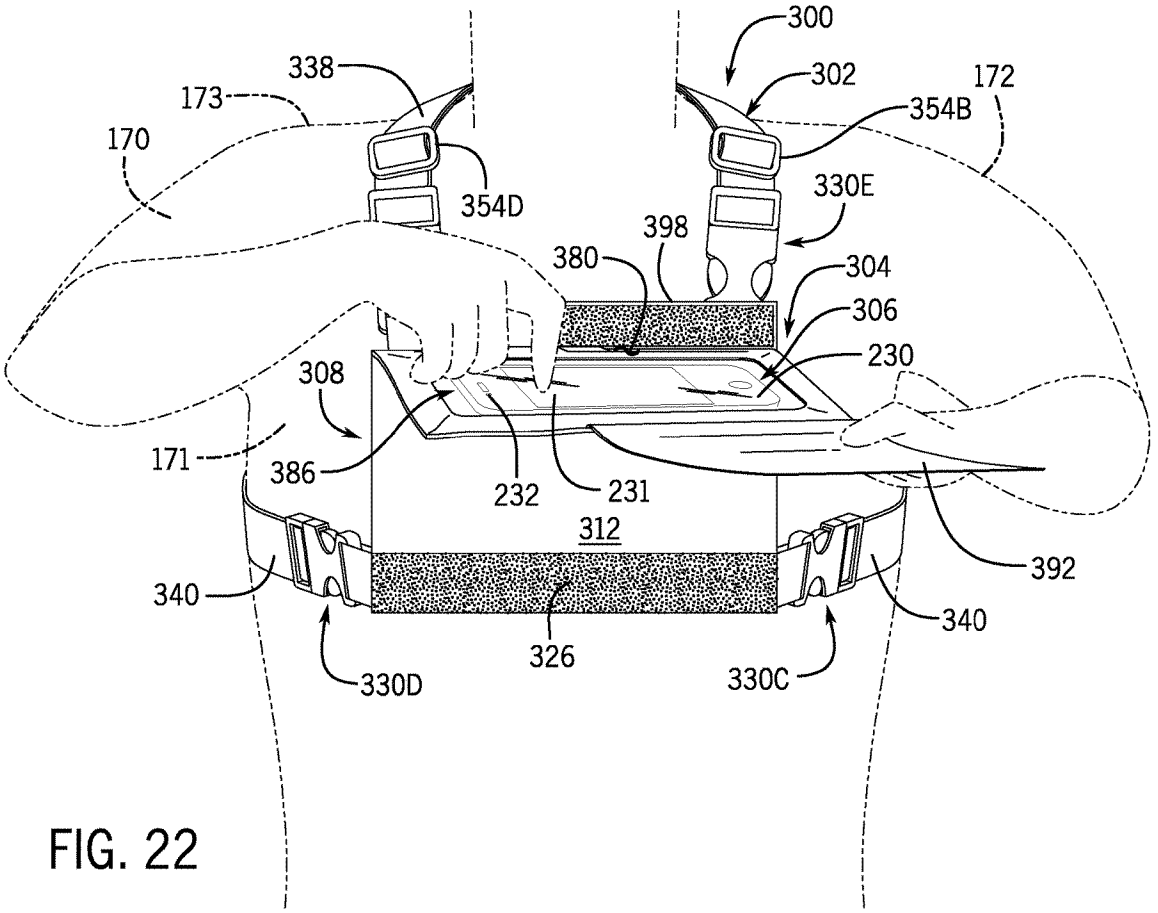
FIG. 22 is a front elevation view of the pack assembly of FIG. 13 shown as it would appear being worn, with the pack in its open position and partially detached from the base of the harness, allowing the pack to be tilted upward to enable viewing and touching of a touchscreen of a mobile device from the windowed pocket of the pack.
Figure 23:
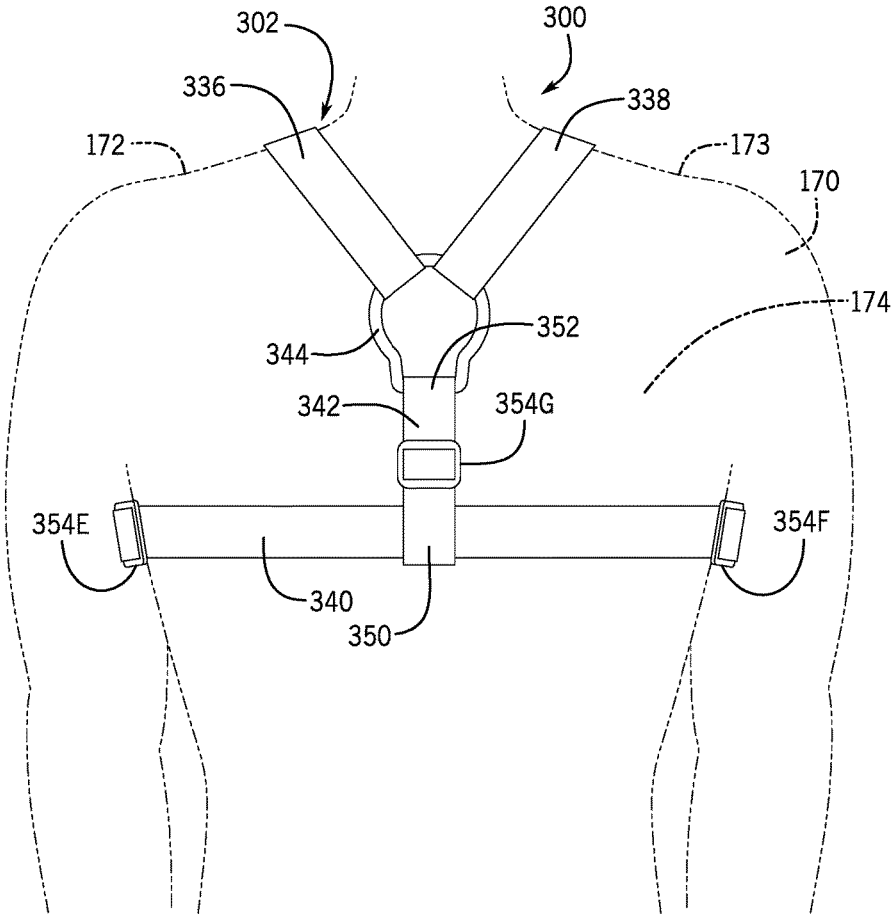
FIG. 23 is a rear elevation view of the pack assembly of FIG. 13 shown as it would appear being worn.

In FIGS. 16 and 17, pack 304 is formed with windowed pocket 306, and pocket inlet 380 to windowed pocket 306. Windowed pocket 306 is formed in outer side 368, and is for receiving a mobile device 230, having touchscreen 231 and camera 232 (as shown in FIG. 22), through pocket inlet 380 so as to juxtapose touchscreen 231 and camera 232 with windowed pocket 306 to enable viewing and touching of touchscreen 231 and taking of pictures and video with camera 232 in the operation of the mobile device 230 from windowed pocket 306, when mobile device 230 is inserted into windowed pocket 306 through pocket inlet 380.

Figure 19:
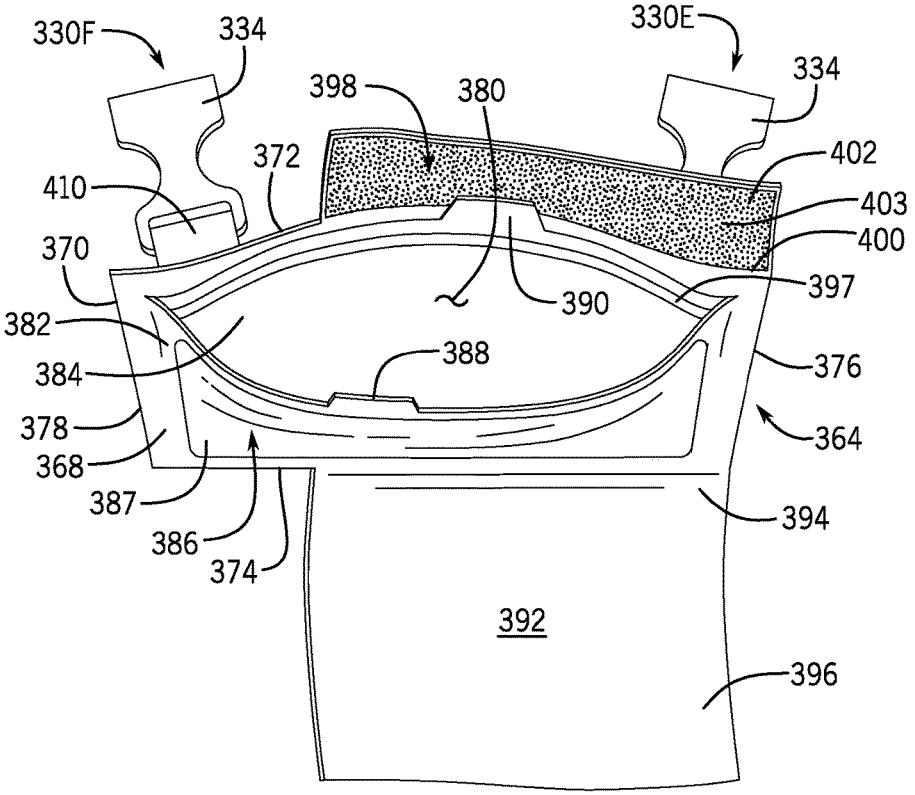
FIG. 19 is a top-down perspective view of the pack of FIG. 16 in its open position, revealing a pocket inlet of the windowed pocket of the pack.
Figure 20:
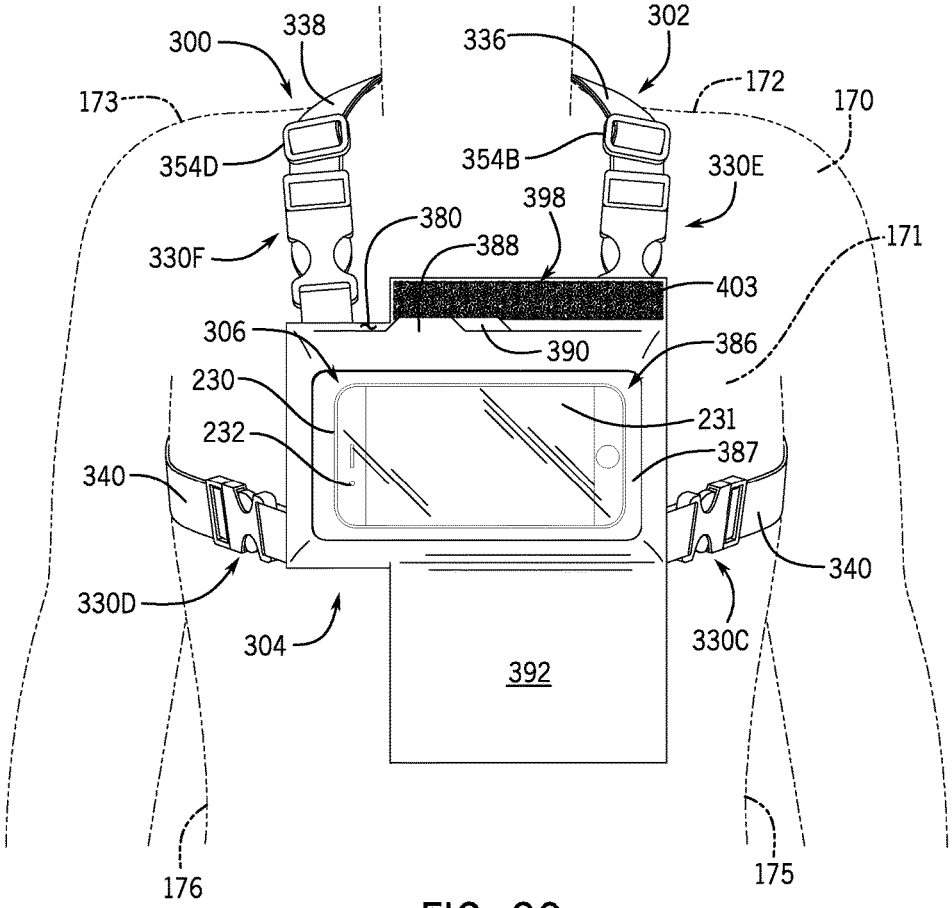
FIG. 20 is a front elevation view of the pack assembly of FIG. 13 shown as it would appear being worn, with the pack in its open position.

Windowed pocket 306 is formed in outer side 368 by a pair of outer and inner pocket panels, including outer or first pocket panel 382 and inner or second pocket panel 384, as shown in FIG. 19. First pocket panel 382 is superimposed atop, and is coextensive with respect to, second pocket panel 384. First and second pocket panels 382 and 384 are joined along their three edges at or adjacent to second end edge 374 and first and second side edges 376 and 378 of peripheral edge 370 of pack 304 and, in some embodiments, partially along their fourth edges at first end edge 372 of peripheral edge 370 of pack 304 so as to form pocket inlet 380 at or adjacent to first end edge 372. First and second pocket panels 382 and 384 are further joined along three sides to form an inside closed portion of windowed pocket 306. First and second pocket panels 382 and 384 can be joined together with stitching, adhesive, heat bonding, or the like. Windowed pocket 306 is therefore accessible through pocket inlet 380. In some embodiments, as shown in FIGS. 17 and 19, first and second pocket panels 382, 384 can each include upper tabs 388, 390 adjacent the pocket inlet 380. For example, tabs 388, 390 can ease opening of pocket inlet 380 to access inside of windowed pocket 306.

In FIGS. 17 and 19, as noted above, pocket inlet 380 to windowed pocket 306 is formed at first end edge 372 of peripheral edge 370. Pocket inlet 380 can be centered or otherwise equidistant between first and second side edges 376 and 378, though need not be in alternate embodiments. Windowed pocket 306 extends downwardly from pocket inlet 380 to proximate to second end edge 374, and can be equidistant between first and second side edges 376 and 378 in some embodiments. First pocket panel 382 of windowed pocket 306 includes window 386 framed by a peripheral edge border or frame of outer side 368. Window 386 is fitted with a thin sheet 387 of transparent material. Sheet 387 is thin in that it can have a thickness of approximately 0.2-0.3 millimeters (e.g., thin enough to permit touch screen capabilities through sheet 387 to mobile device 230 inside pocket 306), and is formed of transparent flexible plastic that is affixed to and held at border or frame of outer side 368, such as by heat bonding, an adhesive, stitching, or the like.

Base 364 further includes a door 392. Door 392, like outer layering, can be fashioned of leather, tightly woven nylon, canvas, or other material or combination of materials having the inherent properties of flexibility, resilience, tear-resistance, and ruggedness. Door 392 can be flat and generally square or rectangular in shape, and includes proximal extremity 394 mounted to outer pocket panel 382 of outer side 368 between second end edge 374 and window 386, and an opposed distal extremity 396. Proximal extremity 394 can be mounted or coupled to first pocket panel 382 with stitching, heat bonding, adhesive, or the like or, alternatively, can be integral with base 364 (e.g., formed as an extension of first pocket panel 382 or other paneling of inner or outer sides 366, 368 of base 364). The inherent material characteristics of door 392 enables door 392 to pivot at proximal extremity 394 between an open position away from windowed pocket 306 in FIGS. 17-19, and a closed position partially over windowed pocket 306 in FIGS. 13 and 16. In other words, in the closed position, distal extremity 396 covers a portion of windowed pocket 306.

Figure 21:
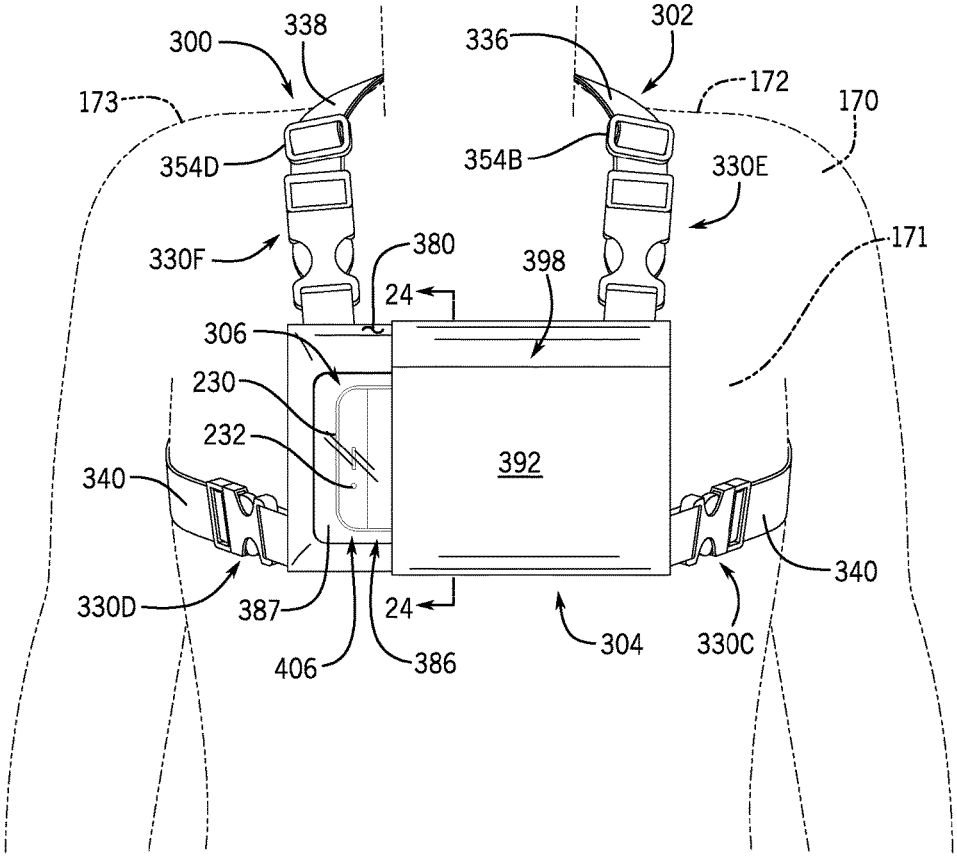
FIG. 21 is a front elevation view of the pack assembly of FIG. 13 shown as it would appear being worn, with the pack in its closed position.
Figure 21A:
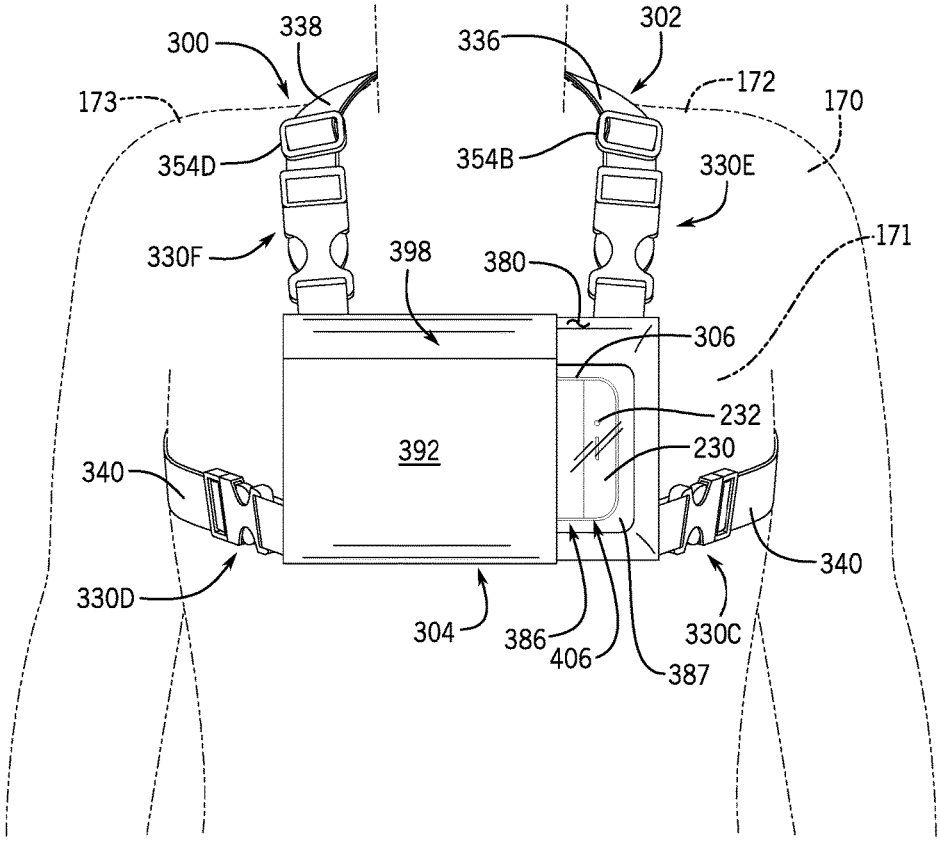
FIG. 21A is a front elevation view of a pack assembly shown as it would appear being worn, including an alternate pack in its closed position.

As shown in FIGS. 16-19, door 392 is positioned off-center between first side edge 376 and second side edge 378 and therefore partially covers windowed pocket 306 when door 392 is in the closed position. More specifically, in the closed position, door 392 can partially cover windowed pocket 306 over touchscreen 231 of mobile device 230, enabling the taking of pictures and video with camera 232 from window 386 of windowed pocket 306 when door 392 is in the closed position, when the mobile device 230 is received in windowed pocket 306, and when touchscreen 231 and camera 232 are juxtaposed with windowed pocket 306. As shown in FIG. 21, the pack 304 can include a first arrangement where door 392 is positioned on the base 364 adjacent first side edge 376 so that a right side portion 406 of windowed pocket 306 (relative to body of wearer 170) is uncovered when door 392 is in the closed position. Alternatively, as shown in FIG. 21A, the pack 304 can include a second arrangement where door 392 is positioned on the base 364 adjacent second side edge 378 so that a left side portion 406 of windowed pocket 306 (relative to body of wearer 170) is uncovered when door 392 is in the closed position. The first and second arrangements can be used based on preference of the wearer 170 (such as a right-handed wearer or a left-handed wearer). For example, the first orientation in FIG. 21 may be considered a left-handed orientation, while the second orientation of FIG. 21A may be considered a right-handed orientation.

Referring back to FIG. 19, second pocket panel 384 can include one or more engagement or fastener elements 397 near first end edge 372 that are registered with the one or more respective fastener elements (not shown) on an inside of first pocket panel 382. The fastener elements 397 can be press-seal type fasteners (such as zip-top or Ziploc type elements), allowing the pocket inlet 380 to be closed or substantially sealed when the fastener elements 397 are pressed together. The above-described tabs 388, 390 can facilitate opening or unsealing the fastener elements 397 to open the pocket inlet 380. In alternate embodiments, other zipper fasteners, hook and loop fasteners, or snap fasteners may be included on or adjacent the first pocket panel 382 and second pocket panel 384 to enable opening and closing of the pocket inlet 380. In yet other alternate embodiments, the pocket inlet 380 does not include fastener elements. More specifically, in such embodiments, pocket inlet 380 need not include a dedicated closure and instead can be substantially closed or covered by door 392 and flap 398, as further described below.

Pack 304 can incorporate a latch assembly for releasably securing door 392 to pack 304 when door 392 is in its closed position, and which enables door 392 to be repeatedly opened and closed. As shown in FIGS. 16-19, pack 304 can include a flap 398 extending from the first end edge 372 of the base 364 (e.g., opposite the proximal extremity 394 of the door 392 at the second end edge 374 of the base 364). Flap 398 includes a proximal extremity 400 and a distal extremity 402. Proximal extremity 400 can be mounted or coupled to first pocket panel 382 with stitching, heat bonding, adhesive, or the like or, alternatively, can be integral with base 364 (e.g., formed as an extension of first pocket panel 382 or other paneling of inner or outer sides 366, 368 of base 364). The inherent material characteristics of flap 398 enables flap 398 to pivot at proximal extremity 400 between an open position away from door 392 in FIGS. 17-19, and a closed position over door 392 (when door 392 is in the closed position) in FIGS. 13 and 16. The latch assembly further includes a hook and loop fastener having an element 403 thereof carried by distal extremity 402 of flap 398, and a complemental element 404 thereof carried by distal extremity 396 of door 392 (shown in FIGS. 13 and 16). Thus, in the closed position, door 392 is positioned partially over windowed pocket 306 and flap 398 is positioned over a portion of door 392, engaging elements 403, 404 and preventing door 392 from swinging down away from windowed pocket 306. In alternate embodiments, the latch assembly can include snap fasteners, a zipper fastener, or other suitable fastening elements.

Latch assembly for door 392 can also serve as a latch or fastening assembly for pocket inlet 380. For example, when latch assembly secures door 392 to pack 304 when door 392 is in closed position, door 392 and flap 398 substantially cover pocket inlet 380. Accordingly, door 392 can be in open position, opening the pocket inlet 380 to enable mobile device 230 to be selectively inserted into windowed pocket 306 through pocket inlet 380 and selectively withdrawn from windowed pocket 306 through pocket inlet 380, according to the principle of the invention. In some embodiments, latch assembly can serve as a fastening assembly for pocket inlet 380 secondary to fastener elements 397 described above, or in place of fastener elements 397.

To employ pack 304 with mobile device 230, mobile device 230 is taken up, such as by hand, and applied sideways into windowed pocket 306 through pocket inlet 380 so as to juxtapose touchscreen 231 and camera 232 with windowed pocket 306 (as shown in FIG. 22) to enable the viewing and the touching of touchscreen 231 and the taking of still pictures and video with camera 232 in the operation of mobile device 230 via sheet 387 of transparent material of windowed pocket 306. The shape of windowed pocket 306 corresponds to the shape of mobile device 230 to ensure mobile device 230 is held snugly by windowed pocket 306. Notably, in contrast to pack 52 of FIGS. 1-12, which provides for an upright orientation of mobile device 230 (e.g., providing a portrait field-of-view of camera 232), pack 304 may permit a sideways orientation of mobile device 230 (e.g., providing a landscape field-of-view of camera 232).

Accordingly, mobile device 230 is oriented in place in windowed pocket 220 in an operative position so as to juxtapose touchscreen 231 and camera 232 with windowed pocket 306 to enable the viewing and touching of touchscreen 231 and the taking of pictures and video in the operation of mobile device 230 via sheet 337 of transparent material. Additionally, mobile device 230 is oriented in place in windowed pocket 220 in an operative position so as to juxtapose camera 232 with an uncovered portion 406 of windowed pocket 306 (i.e., when door 392 is in closed position) to enable taking of pictures and video in the operation of mobile device 230 via sheet 337 of transparent material when the door 392 is in closed position. In other words, door 392 does not hinder field-of-view of camera 232 while in open position or closed position. The uncovered portion 406 may be on the right side, as in the arrangement shown in FIG. 21, or the left side, as in the arrangement shown in FIG. 21A.

Pack 304 is configured or otherwise adapted to be coupled to, and carried by, harness 302. For example, base 308 of harness 302 may be considered in an open position in FIG. 15 when pack 304 (not shown in FIG. 15) is detached from inner side 312 base 308, that is, when fastener elements 326 are detached from complemental fastener elements 328 of pack 304. Referring in relevant part to FIGS. 13-15, to attach pack 304 to base 308 from the open position of base 308, inner side 366 of pack 304 is superimposed atop inner side 312 of base 308 so as to juxtapose first end edge 372 of pack 304 with first end edge 318 of base 308, so as to juxtapose second end edge 374 of pack 304 with second end edge 320 of base 308, so as to juxtapose first side edge 376 of pack 304 with first side edge 322 of base 308, and so as to juxtapose second side edge 378 of pack 304 with second side edge 324 of base 308. After so positioning pack 304 on base 308, in which base 308 and pack 304 are axially aligned, base 308 and pack 304 are pressed together to engage fastener elements 326, 328 and to releasably couple pack 304 to base 308.

Additionally, to further attach pack 304 to harness 302, female buckle members 334 of buckles 330E, 330F, which are coupled to pack 304, are coupled releasably to male buckle members 332 of buckles 330E, 330F, which are coupled to left and right shoulder straps 336, 338 of strap assembly 310, as described above. More specifically, as shown in FIG. 13, connecting strap 408 is attached to first end edge 372 proximate to first side edge 376 and is coupled to female buckle member 334 of buckle 330E. Male buckle member 332 of buckle 330E is coupled releasably to female buckle member 334 of buckle 330E, and left shoulder strap 336 extends rearwardly from male buckle member 332 of buckle 330E, through strap adjuster 354A, toward tie-down ring 344. Connecting strap 410 is attached to first end edge 372 proximate to second side edge 378 and is coupled to female buckle member 334 of buckle 330F. Male buckle member 332 of buckle 330F is coupled releasably to female buckle member 334 of buckle 330F, and right shoulder strap 338 extends rearwardly from male buckle member 332 of buckle 330F, through strap adjuster 354C, toward tie-down ring 344.

To detach pack 304 from harness 302, the foregoing pack installation method need only be reversed. Pack 304 can be so repeatedly attached and detached relative to harness 302. Furthermore, pack 304 can be independently attached and detached relative to base 308 or strap assembly 310. For example, pack 304 can be attached to harness 302 only via base 308, as described above. Alternately, pack 304 can be attached to harness 302 only via strap assembly 310, as described above and shown in FIG. 22. The latter attachment allows pack 304 to be moved relative to base 308, for example, to permit a wearer to view the windowed pocket 306 and interact with the touchscreen 231 of the mobile device 230 when harness is worn by wearer 170, as shown in FIG. 22.

When mobile device 230 is inserted into windowed pocket 220 and pack 304 is coupled removably to harness 302 and door 392 is secured in its closed position in FIG. 13, pack assembly 300 is ready for use to employ mobile device 230 usefully as a body camera for taking still pictures and video with camera 232 for recording the wearer's interactions with the environment and others, according to the principle of the invention. Base 308 of harness 302 is configured to be positioned against the chest of the upper torso of the wearer for holding pack 304 ahead of the chest of the upper torso of the wearer with windowed pocket 306 facing outwardly relative to the chest of the upper torso of the wearer, as shown in FIG. 21. Referring again to FIGS. 21-23, as described above, outer side 314 of base 308 positioned against chest 171 of wearer 170, left shoulder strap 336 extends over left shoulder 172 of wearer 170 from base 308 to tie-down ring 344 centered along the upper part of back 174 of wearer 170, right shoulder strap 338 extends over right shoulder 173 of wearer 170 from base 308 to tie-down ring 344 centered along the upper part of back 174 of wearer 170, waist strap 340 extends over left waist 175 (or chest) of wearer 170 from base 308, through back strap 342 centered along the lower part of back 174 of wearer 170, and over right waist 176 (or chest) of wearer 170 to base 308, and back strap 342 extends downwardly along the center of back 174 of wearer 170 from tie-down ring 344 to waist strap 340, when harness 302 is worn by wearer 170. From this position, door 392 can be selectively opened to enable wearer 170 to view and touch touchscreen 231 and take pictures and video with camera 232 in the operation of mobile device 230 via sheet 387 of transparent material of windowed pocket 306 as a body camera for recording the wearer's interactions with the environment and others with camera 232. Furthermore, door 392 partially covers windowed pocket 306 and protects mobile device 230 applied therein, and uncovered portion 406 of windowed pocket 220 is juxtaposed with camera 232 for enabling the use of mobile device 230 as a body camera, namely, for the taking of pictures and video with camera 232 when door 392 is in the closed position, when the mobile device 230 is received in windowed pocket 306, and when touchscreen 231 and camera 232 are juxtaposed with windowed pocket 306. Thus, camera functionality of mobile device 230 is enabled when door 392 is in open and closed positions.

Figure 24C:
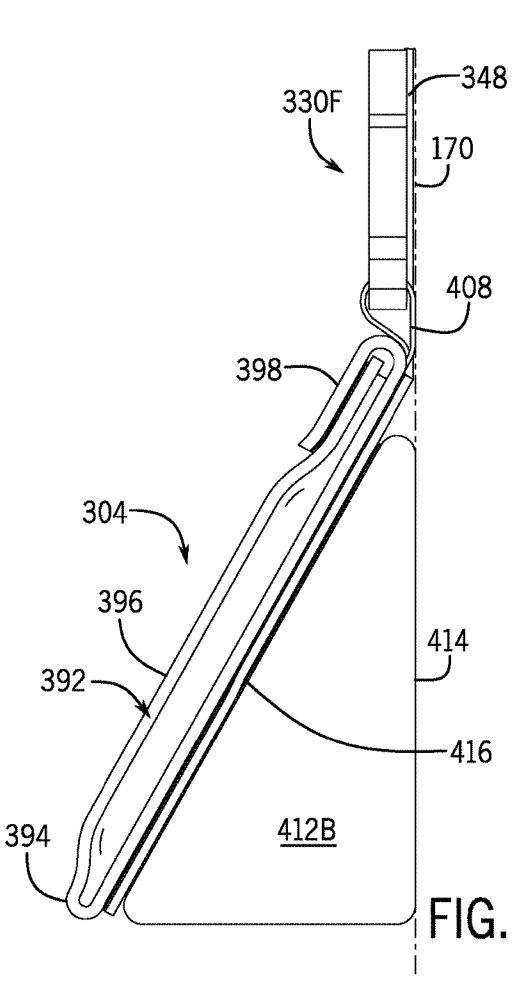
FIG. 24C is a section view corresponding to FIG. 24A illustrating a second spacer coupled to a back of the base for concurrently tipping the base and the pack upwardly relative to a chest of an upper torso of a wearer, when the harness is worn by the upper torso of the wearer.
Figure 24B:
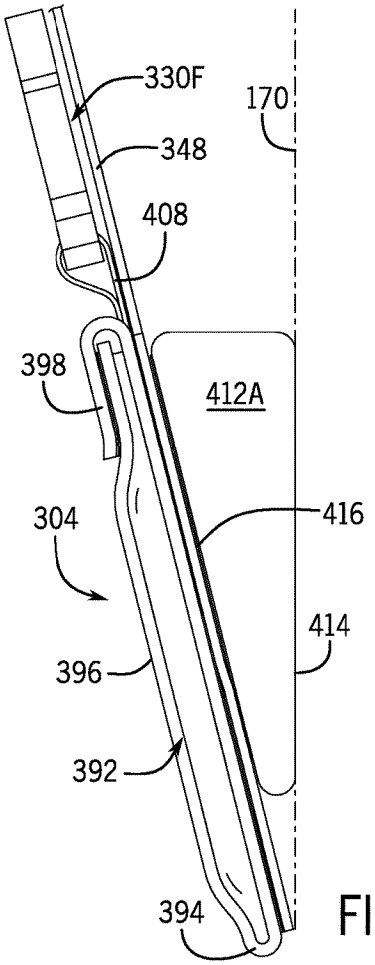
FIG. 24B is a section view corresponding to FIG. 24A illustrating a first spacer coupled to a back of the base for concurrently tipping the base and the pack downwardly relative to a chest of an upper torso of a wearer, when the harness is worn by the upper torso of the wearer.
Figure 24A:
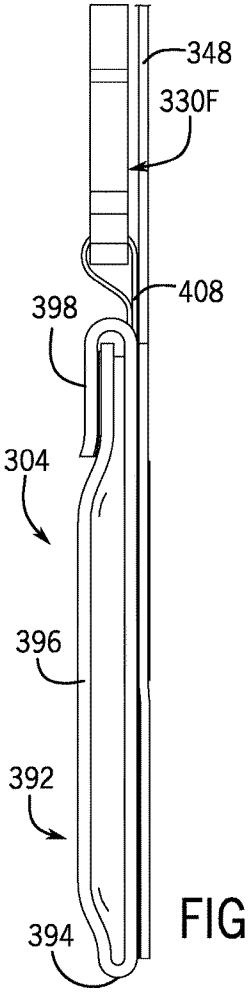
FIG. 24A is a section view taken along line 24-24 of FIG. 21.

Additionally, pack assembly 300 can incorporate one or more spacers 412 configured to tip the pack 304 relative to the chest of the wearer. For example, FIG. 24A is a sectional view of pack assembly 300 corresponding to line 24-24 of FIG. 21. FIG. 24B is a view corresponding to FIG. 24A illustrating a first spacer 412A coupled to outer side 314 of base 308 of harness 302, tipping/tilting pack 304 downwardly relative to chest of wearer 170 for concurrently tipping mobile device 230 held by pack 304 downwardly relative to wearer 170 when mobile device 230 is inserted into windowed pocket 306. FIG. 24C is a view corresponding to FIG. 24A illustrating a second spacer 412B coupled to outer side 314 of base 308 of harness 302, tipping/tilting pack 304 upwardly relative to chest of wearer 170 for concurrently tipping mobile device 230 held by pack 304 upwardly relative to wearer 170 when mobile device 230 is inserted into windowed pocket 306.

In FIGS. 24B and 24C, spacers 412 can be wedge-shaped (e.g., having a substantially triangular cross-section) and made of foam, plastic, or the like. Furthermore, spacers 412 can include different sizes. For example, FIG. 24B includes a first size spacer 412A (e.g., a smaller size) and FIG. 24C includes a second size spacer 412B (e.g., a larger size). Additional sizes may be available in further embodiments. A wearer can select a particular sized spacer 412 based on preference and needs. For example, size of spacer 270 can be chosen to increase and decrease the down-angled and the up-angled field of view of camera 232 of mobile device 230.

As noted above, spacers 412 can be wedge-shaped. For example, spacers 412 can include a first straight side 414 and a second angled side 416. Straight side 414 can be configured to rest against chest 171 of wearer 170 when spacer 412 is used with the pack assembly 300, and angled side 416 can be coupled to base 308 of harness 302, for example, with an engagement mechanism. As discussed above, in one embodiment, engagement mechanism can be a hook and loop fastener mechanism. As shown in FIG. 14, an elongate strip of hook and loop fastener 325 can be applied across outer side 314 of base 308, from first side edge 322 to second side edge 324. A complementary hook and loop fastener (not shown) can be applied across angled side 416 so that fasteners 325 are engaged when angled side 416 is pressed against outer side 314 of base 308, as shown in FIGS. 24B and 24C. The complementary hook and loop fastener can be applied to the angled side 416 at a location that permits engagement with the base 308 when spacer 412 is in a first orientation (e.g., to permit downward tilting, as shown in FIG. 24B), or when spacer 412 is flipped in a second orientation (e.g., to permit upward tilting, as shown in FIG. 24C). In other embodiments, a plurality of smaller strips or squares of hook and loop fastener can be positioned along outer side 314 and angled side 416. Furthermore, in other embodiments, other engagement mechanisms may be contemplated.

Accordingly, spacer 412 can be selectively installed against base 308 for providing a selected down-angled or up-angled field of view of camera 232 as desired by the wearer of pack assembly 300. More specifically, pack 304 and mobile device 230 held by pack 304 are concurrently tipped/tilted downwardly relative to chest 171 of wearer 170 in FIG. 24B when spacer 412 is applied to base 308 in a first orientation, when mobile device 230 is carried by pack 304, when pack 304 is coupled to base 308 of harness 302, and when harness 302 is worn by the upper torso of the wearer 170, so as to provide a selected down-angled field of view of camera 232 as desired by the wearer of pack assembly 300. Furthermore, pack 304 and mobile device 230 held by pack 304 are concurrently tipped/tilted upwardly relative to chest 171 of wearer 170 in FIG. 24C when spacer 412 is applied to base 308 in a second orientation, when mobile device 230 is carried by pack 304, when pack 304 is coupled to base 308 of harness 302, and when harness 302 is worn by the upper torso of the wearer 170, so as to provide a selected up-angled field of view of camera 232 as desired by the wearer of pack assembly 300. Additionally, other types of spacers can be contemplated for use with the pack assembly 300 in other embodiments.

§ VI. Alternative Embodiment of Wearable Pack Assembly for Leg

Figure 25:
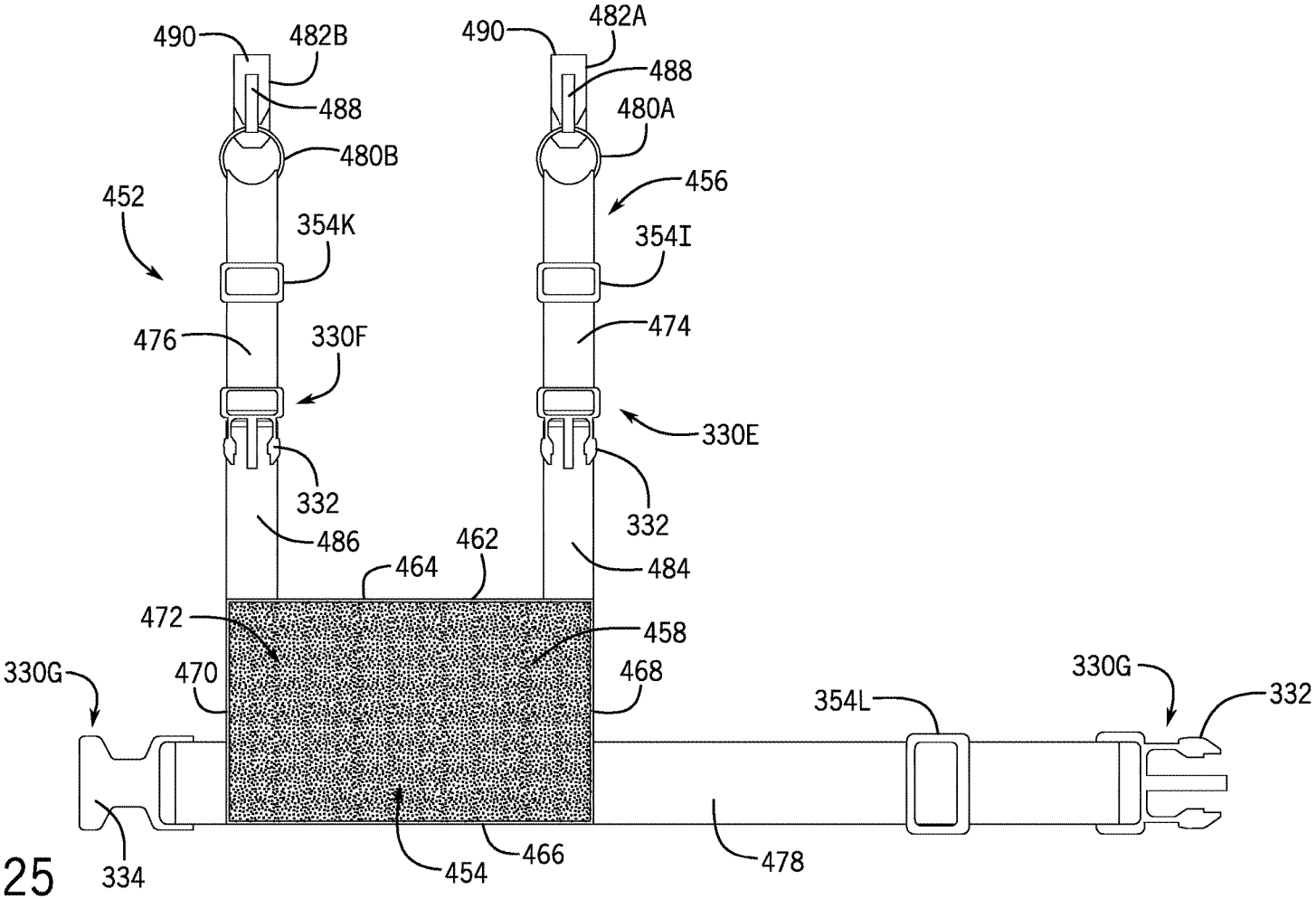
FIG. 25 is a front view of a harness of a wearable pack assembly for a mobile device according to another embodiment, the harness capable of being used with the pack of FIGS. 13-24C.
Figure 26:
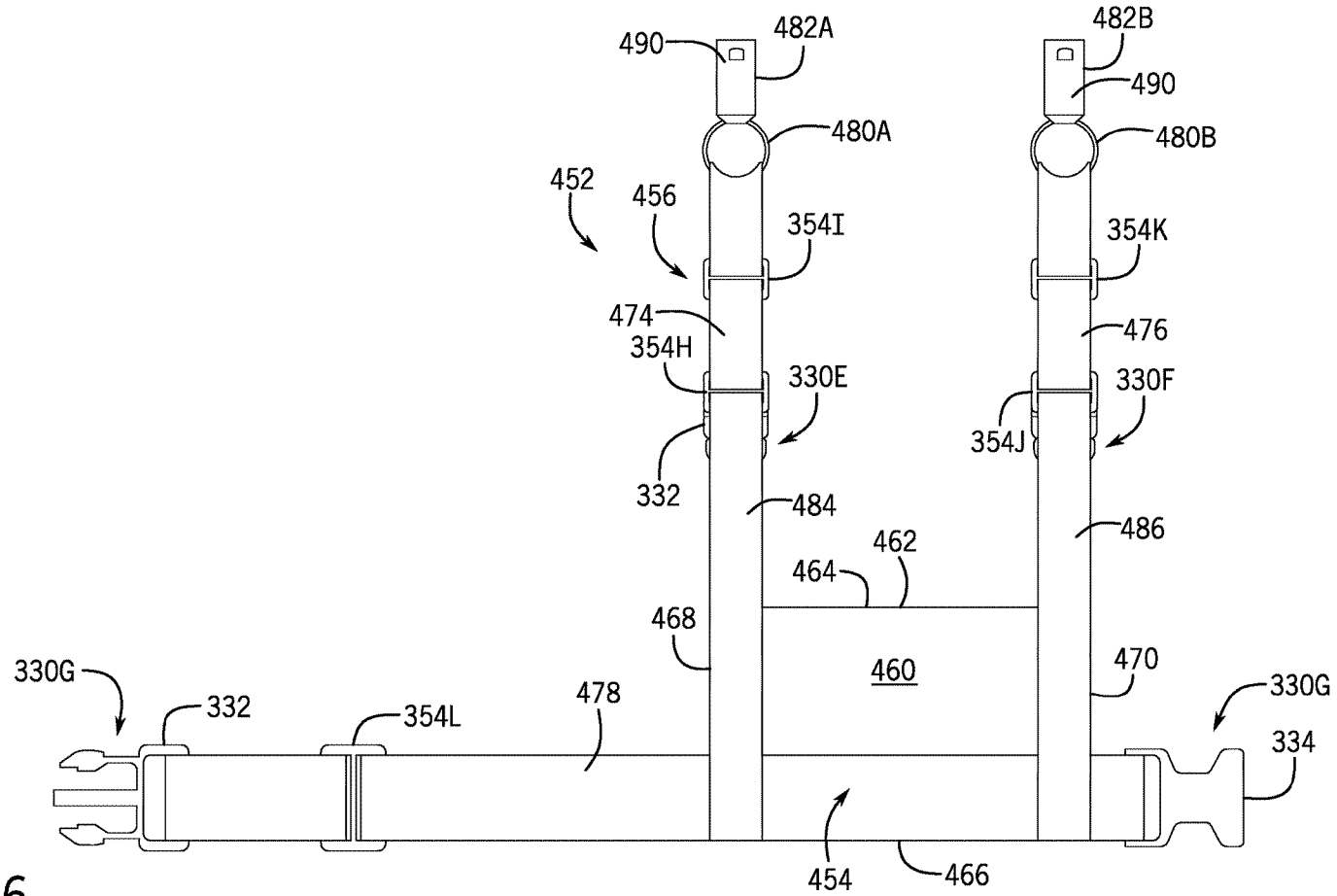
FIG. 26 is a rear view of the harness of FIG. 25.
Figure 27:
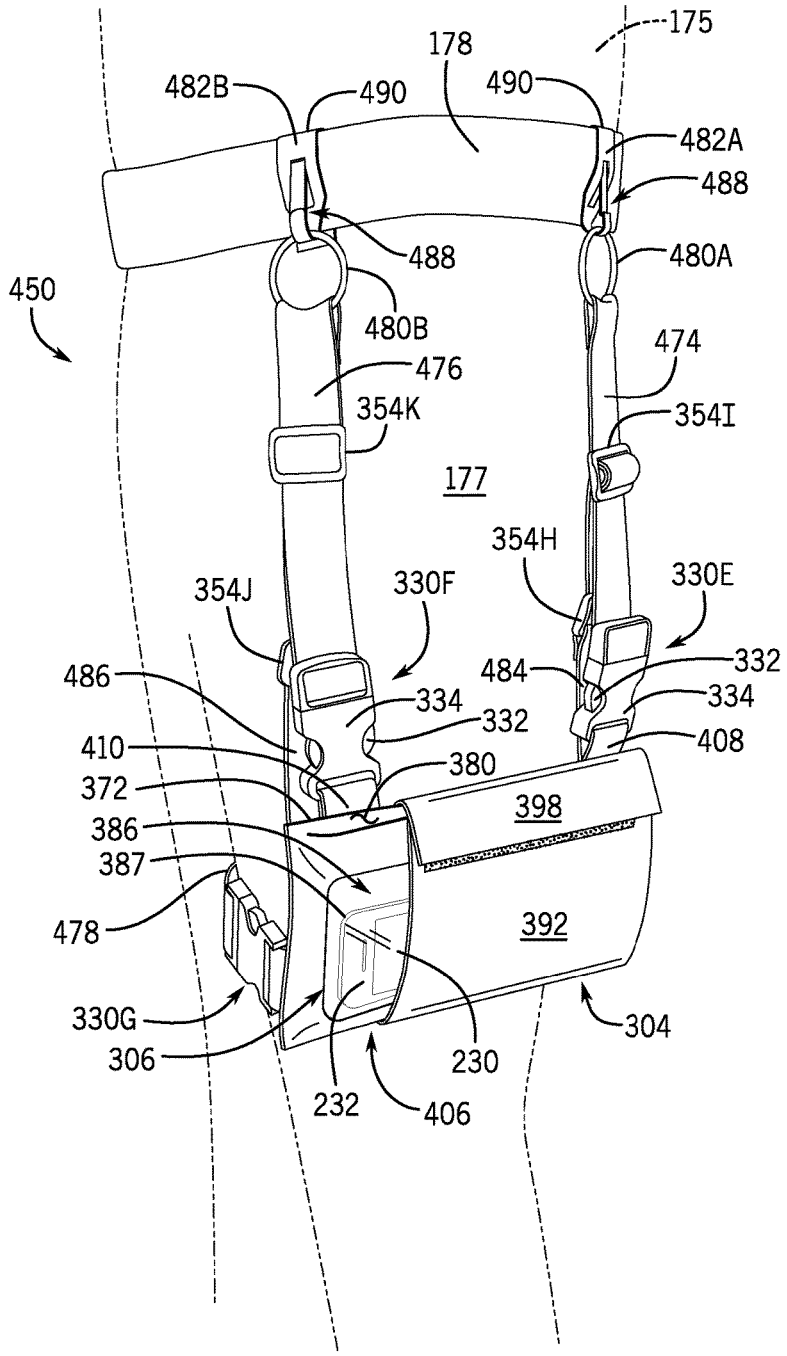
FIG. 27 is a perspective view of the wearable pack assembly, including the harness of FIGS. 25-26 and the pack of FIGS. 13-24C, shown as it would appear being worn.
Figure 28:
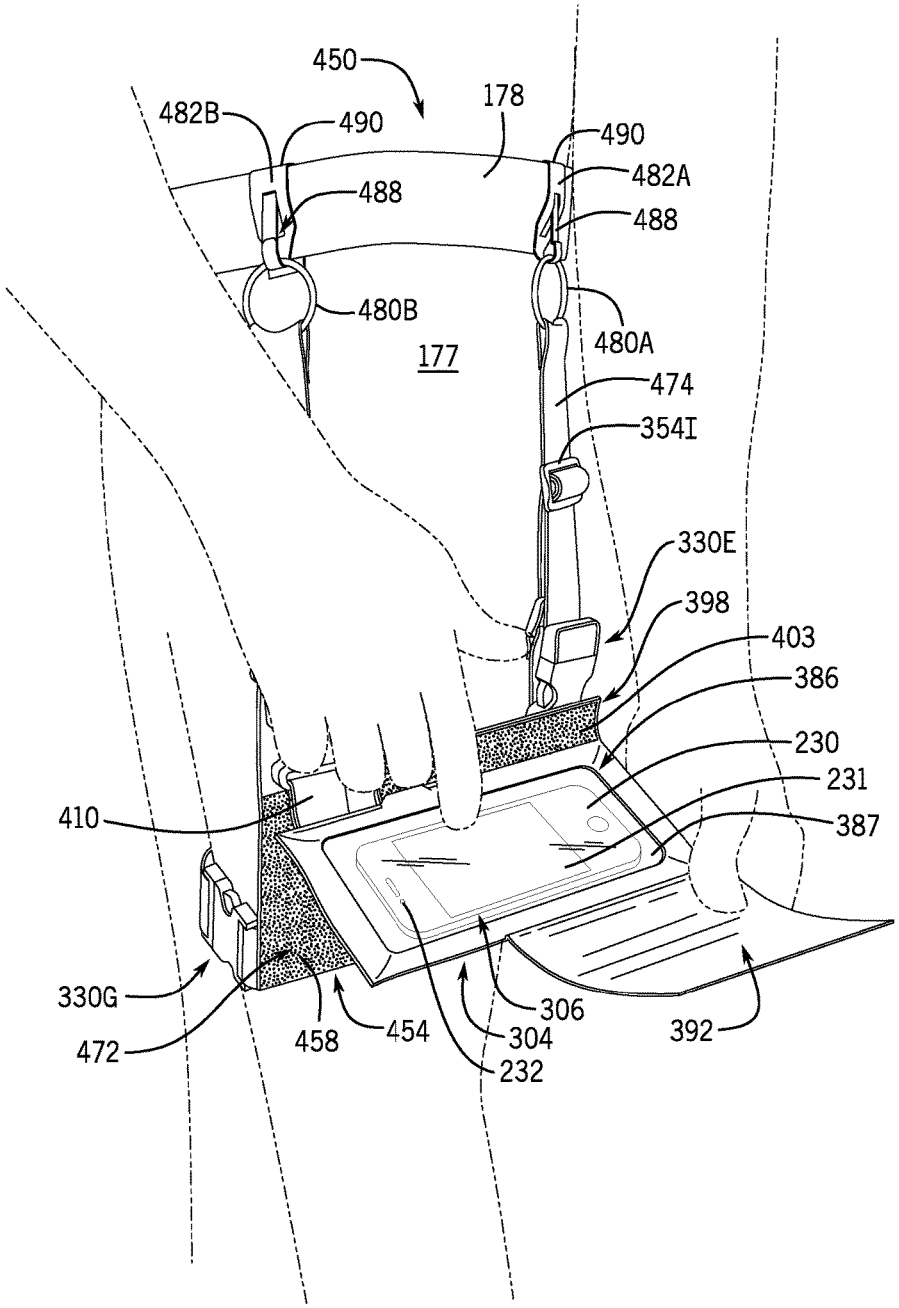
FIG. 28 is a perspective view of the pack assembly of FIG. 27 shown as it would appear being worn, with the pack in its open position and partially detached from the base of the harness, allowing the pack to be tilted upward to enable viewing and touching of a touchscreen of a mobile device from the windowed pocket of the pack.

FIGS. 25-28 illustrate a wearable pack assembly 450 for a mobile device according to another embodiment. Pack assembly 450 includes a harness 452 and a pack 304. Harness 452 is wearable, and pack 304 is configured to be carried by harness 452, as shown in FIGS. 27-28. Generally, pack 304 can be the same as described above with respect to the pack assembly 300 of FIGS. 13-24 and, thus, includes a windowed pocket 306 for receiving a mobile device through an opening to windowed pocket 306 so as to juxtapose a touchscreen and a camera of the mobile device with the windowed pocket 306 to enable the viewing and the touching of the touchscreen and the taking of pictures and video with the camera in the operation of the mobile device from windowed pocket 306. Harness 452 is configured to hold pack 304 against a leg of a wearer with windowed pocket 306 facing outwardly relative to the leg of the wearer when harness 452 is worn by the leg of the wearer and when pack 304 is carried by harness 452 for enabling the wearer to usefully employ the camera of the mobile device as a body camera for recording a wearer's interactions with the environment when the mobile device is carried operatively by the pack 304.

With respect to the harness 452, referring to FIGS. 25-28, the harness 452 can include a base 454 and strap assembly or system 456. The base 454 can be flat and generally rectangular in overall shape. In some embodiments, the base 454 is a panel assembly including a panel covered with outer layering consisting of one or more layers of material, similar to that described above with respect to base 60 of FIGS. 1-12. For example, panel is upholstered with outer layering, which encloses panel and defines the major sides and peripheral edge of base 454, as described below.

Referring in relevant part to FIGS. 25-26, base 454 can include inner side 458 and opposed outer side 460, and peripheral edge 462. As shown in FIG. 25, peripheral edge 462 can be defined by first end edge 464 and opposed second end edge 466, and first side edge 468 and opposed second side edge 470 that extend from the first end edge 464 to second end edge 466. First and second end edges 464 and 466 are parallel with respect to each other, and first and second side edges 468 and 470 are parallel with respect to each other and are orthogonal with respect to first and second end edges 464 and 466. Base 454 therefore has a length from first end edge 464 to second end edge 466 and a width from first side edge 468 to second side edge 470. As shown, the length of base 454 can be shorter than the width of base 454, characterizing the generally rectangular shape of base 454. Furthermore, base 454 can be generally the same shape as pack 304 and/or same shape and size as base 308 of FIGS. 13-24.

Pack assembly 450 can include an engagement assembly for removably coupling pack 304 to base 454. For example, the engagement assembly includes a hook and loop fastener 472 on the inner side 458 of the base 454, as shown in FIG. 25, configured to engage a mating hook and loop fastener 328 on the pack 304, as shown in FIG. 18 and as further described below. In alternate embodiments, the hook and loop fasteners 472, 328 can be button fasteners, snap fasteners, or the like. Additionally, the engagement assembly includes buckles 330, similar to buckles 145 described above. For example, the harness 452 can include male buckle members 332 and the pack 304 can include female buckle members 334 configured to engage the male buckle members 332 of the harness 452, as further described below, to removably couple pack 304 to base 454.

In FIGS. 25-26, strap assembly 456 is connected to base 454, is used to strap base 454 to the leg of the wearer, and includes left and right upper straps 474, 476 and a leg strap 478. Leg strap 478 can be connected in a loop via buckle 330G, and left and right upper straps 474, 476 can be coupled to a wearer's pants or belt 178 (as shown in FIGS. 27-28) via rings 480 detachably coupled to hook members 482. However, other buckles, fastening, or attachment mechanisms may be used in other embodiments. Straps 474-478 are each fashioned of leather, tightly woven nylon, canvas, or other material or combination of materials having the properties of flexibility, resilience, tear-resistance, and ruggedness, and are conventionally length-adjustable straps. Additionally, different straps can incorporate different materials. For example, in some embodiments, one or more of straps 474-478 are fashioned of an elastic material, while one or more of connecting straps of strap assembly 456 (described below) are fashioned of a non-elastic webbing material.

As shown in FIGS. 25-26, left and right upper straps 474, 476 can be coupled to first end edge 464 (e.g., at either end thereof), and to respective rings 480 detachably coupled to hook members 482. Leg strap 478 extends from first side edge 468 and second side edge 470, for example, near second end edge 466 and is connected together with buckle 330G.

More specifically, left connecting strap 484 is attached to base 454 near first side edge 468, extends upward from first end edge 464, and is coupled to (e.g., looped through) a strap adjuster 354H. As shown in FIG. 26, left connecting strap 484 can extend the length of base 454 from first end edge 464 to second end edge 466. However, in other embodiments, left connecting strap 484 is coupled to first end edge 464. Left upper strap 474 is routed through strap adjuster 354H and includes male buckle member 332 at its forward end that is part of the engagement assembly described above (e.g., of buckle 330E). Left upper strap 474 extends upwardly from strap adjuster 354H and loops around ring 480A, which is further releasably coupled to hook member 482A. Additionally, left upper strap 474 can include an additional strap adjuster 354I to permit shortening or lengthening of left upper strap 474.

Right connecting strap 486 is attached to base 454 near second side edge 470, extends upward from first end edge 464, and is coupled to (e.g., looped through) a strap adjuster 354J. As shown in FIG. 26, right connecting strap 486 can extend the length of base 454 from first end edge 464 to second end edge 466. However, in other embodiments, right connecting strap 486 is coupled to first end edge 464. Right upper strap 476 is routed through strap adjuster 354J and includes a male buckle member 332 at its forward end that is part of the engagement assembly described above (e.g., of buckle 330F). Right upper strap 476 extends upwardly from strap adjuster 354J and loops around ring 480B, which is further releasably coupled to hook member 482B. Additionally, right upper strap 476 can include an additional strap adjuster 354K to permit shortening or lengthening of right upper strap 476.

Additionally, as noted above, rings 480 are releasably coupled to hook members 482. For example, each hook member 482 can be made of plastic, metal, or another suitable material and can include a releasable clasp 488 configured to receive and secure ring 480 to hook member 482. Each hook member 482 also includes a clip portion 490 configured to engage belt 178 or pants of wearer 170 (e.g., similar to a belt clip).

Furthermore, leg strap 478 is connected to base 454 along second end edge 466 and extends rearwardly from both first side edge 468 and second side edge 470. For example, leg strap 478 extends from first side edge 468 and is coupled to (e.g., looped through) male buckle member 332 of buckle 330G. Leg strap 478 also extends from second side edge 470 and is coupled to (e.g., looped through) female buckle member 334 of buckle 330G, which can be releasably coupled to male buckle member 332 of buckle 330G to form a leg strap 478 loop. Alternatively, in some embodiments, leg strap 478 can include two straps separately coupled to and extending from either side edge 468, 470 of base 454. Additionally, leg strap 478 can include one or more strap adjusters 354H to permit shortening or lengthening of leg strap 478.

Referring in relevant part to FIGS. 27-28, outer side 460 of base 454 is positioned against leg 177 of human wearer 170. For example, outer side 460 of base 454 can be positioned against side of upper leg (or thigh) 177 of human wearer 170. Hook members 482 (specifically, clip portions 490 of hook members 482) are attached to belt 178 or pants of human wearer 170 (e.g., along side of hip or waist of wearer 170). Left upper strap 474 extends upward along leg 177 of wearer 170 from base 454 to ring 480A, which is releasably coupled to clasp 488 of hook member 482A. Right upper strap 476 extends upward along leg 177 of wearer 170 from base 454 to ring 480B, which is releasably coupled to clasp 488 hook member 482B. Leg strap 478 extends around leg 177 of wearer 170. Male and female buckle members 332 and 334 of at least one respective buckle 330 can be selectively de-united and united to enable wearer 170 to put on harness 452. Lengths of straps 474-478 can be length-adjusted as needed (e.g., via strap adjusters 354) in order to fit harness 452 snugly/closely to wearer 170, especially on the outside of the wearer's garment(s). While harness 452 is shown attached to side of left leg of wearer 170 in FIGS. 27-28, harness 452 can alternately be attached to front of left leg of wearer 170, side of right leg of wearer 170, or front of right leg of wearer 170. Accordingly, left and right upper straps 474, 476, though described as "left" and "right," may instead be considered first and second upper straps, front and rear upper straps, or right and left upper straps when the harness 452 is positioned in certain orientations relative to wearer 170.

With respect to the pack 304, pack 304 illustrated in FIGS. 27-28 can be equivalent to that described above with respect to FIGS. 13-24. The description of pack 304 above with respect to the pack assembly 300 therefore applies to pack 304 of leg pack assembly 450 in the present embodiment. As such, in some embodiments, pack 304 can be interchangeable between the torso pack assembly 300 of FIGS. 13-24 and the leg pack assembly 450 of FIGS. 25-28. However, in other embodiments, a different pack may be contemplated with the leg pack assembly 450 of FIGS. 25-28.

Accordingly, pack 304 is configured or otherwise adapted to be coupled to, and carried by, harness 452. For example, base 454 of harness 452 may be considered in an open position in FIG. 25 when pack 304 (not shown in FIG. 25) is detached from inner side 458 of base 454 and when fastener elements 472 are detached from complemental fastener elements 328 of pack 304. Referring in relevant part to FIGS. 27-28, to attach pack 304 to base 454 from the open position of base 454, inner side 366 of pack 304 is superimposed atop inner side 458 of base 454 so as to juxtapose first end edge 372 of pack 304 with first end edge 464 of base 454, so as to juxtapose second end edge 374 of pack 304 with second end edge 466 of base 454, so as to juxtapose first side edge 376 of pack 304 with first side edge 468 of base 454, and so as to juxtapose second side edge 378 of pack 304 with second side edge 470 of base 454. After so positioning pack 304 on base 454, in which base 454 and pack 304 are axially aligned, base 454 and pack 304 are pressed together to engage fastener elements 472, 328 and to releasably couple pack 304 to base 454. As shown in FIG. 25, hook and loop fastener 472 can span the entire, or substantially the entire, inner side 458 of base 454, for example, to more firmly attach pack 304 to base 454 (e.g., in comparison to the strip of hook and loop fastener 326 on base 308 of FIGS. 13-24).

Additionally, to further attach pack 304 to harness 452, female buckle members 334 of buckles 330E, 330F, which are coupled to pack 304, are coupled releasably to male buckle member 332 of buckles 330E, 330F, which are coupled to left and right upper straps 474, 476 of strap assembly 456. More specifically, connecting strap 408 is attached to first end edge 372 proximate to first side edge 376 and is coupled to female buckle member 334 of buckle 330E. Male buckle member 332 of buckle 330E is coupled releasably to female buckle member 334 of buckle 330E, and left upper strap 474 extends upwardly from male buckle member 332 of buckle 330E, through strap adjuster 354I, toward ring 480A. Connecting strap 410 is attached to first end edge 372 proximate to second side edge 378 and is coupled to female buckle member 334 of buckle 330F. Male buckle member 332 of buckle 330F is coupled releasably to female buckle member 334 of buckle 330F, and right upper strap 476 extends upwardly from male buckle member 332 of buckle 330F, through strap adjuster 354K, toward ring 480B.

To detach pack 304 from harness 452, the foregoing pack installation method need only be reversed. Pack 304 can be so repeatedly attached and detached relative to harness 452. Furthermore, pack 304 can be independently attached and detached relative to base 454 or strap assembly 456. For example, pack 304 can be attached to harness 452 only via base 454, as described above. Alternately, pack 304 can be attached to harness 452 only via strap assembly 456, as described above and shown in FIG. 28. The latter attachment allows pack 304 to be moved relative to base 454, for example, to permit a wearer to view the windowed pocket 306 and interact with the touchscreen 231 of the mobile device 230 when harness 452 is worn by wearer 170, as shown in FIG. 28.

When mobile device 230 is inserted into windowed pocket 220 and pack 304 is coupled removably to harness 452 and door 392 is secured in its closed position in FIG. 27, pack assembly 450 is ready for use to employ mobile device 230 usefully as a body camera for taking still pictures and video with camera 232 for recording the wearer's interactions with the environment and others, according to the principle of the invention. Base 454 of harness 452 is configured to be positioned against the leg of the wearer for holding pack 304 beside leg of the wearer with windowed pocket 306 facing outwardly relative to the side of leg of the wearer, as shown in FIG. 27. As described above, in some embodiments, base 454 of harness 452 can be configured to be positioned against leg 177 of wearer 170 for holding pack 304 in front of leg 177 of wearer 170 with windowed pocket 306 facing outwardly relative to the front of leg 177 of the wearer 170.

Referring again to FIGS. 27-28, as described above, inner side 458 of base 454 can be positioned against side of leg 177 of human wearer 170, hook members 482 are attached to belt 178 or pants of human wearer 170 (e.g., along side of hip or waist), left upper strap 474 extends upward along leg 177 of wearer 170 from base 454 to ring 480A, which is releasably coupled to hook member 482A, right upper strap 476 extends upward along leg 177 of wearer 170 from base 454 to ring 480B, which is releasably coupled to hook member 482B, and leg strap 478 extends around leg 177 of wearer 170 when harness 452 is worn by wearer 170. From this position, door 392 of pack 304 can be selectively opened to enable wearer 170 to view and touch touchscreen 231 and take pictures and video with camera 232 in the operation of mobile device 230 via sheet 387 of transparent material of windowed pocket 306 as a body camera for recording the wearer's interactions with the environment and others with camera 232. Furthermore, door 392 partially covers windowed pocket 306 and protects mobile device 230 applied therein and uncovered portion 406 of windowed pocket 220 is juxtaposed with camera 232 for enabling the use of mobile device 230 as a body camera, namely, for the taking of pictures and video with camera 232 when door 392 is in the closed position, when the mobile device 230 is received in windowed pocket 306, and when touchscreen 231 and camera 232 are juxtaposed with windowed pocket 306. Thus, camera functionality of mobile device 230 is enabled when door 392 is in open and closed positions. Furthermore, while a first pack orientation is shown in FIGS. 27-28 (e.g., similar to the first orientation shown in FIG. 21), the pack assembly 450 of some embodiments can include a pack 304 having a second pack orientation (e.g., similar to the second orientation shown in FIG. 21A).

Additionally, in some embodiments, pack assembly 450 can include one or more spacers configured to tip the pack 304 relative to leg 177 of wearer 170. Such spacers can be similar to spacers 412 described above with respect to FIGS. 24A-24C. For example, base 454 can include an engagement mechanism, such as a hook and loop fastener (not shown) on outer side 460 to engage spacers. In such embodiments, a spacer coupled to outer side 460 of base 454 of harness 452 can tip/tilt pack 304 downwardly relative to leg of wearer 170 for concurrently tipping mobile device 230 held by pack 304 downwardly relative to wearer 170 when mobile device 230 is inserted into windowed pocket 306. Alternatively, a spacer coupled to outer side 460 of base 454 of harness 452 can tip/tilt pack 304 upwardly relative to leg of wearer 170 for concurrently tipping mobile device 230 held by pack 304 upwardly relative to wearer 170 when mobile device 230 is inserted into windowed pocket 306.

In light of the above, embodiments of the invention provide a wearable pack assembly to be worn by a wearer. The pack assembly includes a harness with a base and a strap assembly configured to be strapped to the wearer (e.g., to the wearer's torso or leg). A pack is removably coupled to the base, and the pack includes a windowed pocket having an inlet for receiving a mobile device and is configured to enable viewing and touching of the touchscreen and taking of pictures and video with the camera from the windowed pocket. The pack also includes a door being movable between an open position away from the windowed pocket and a closed position at least partially covering the windowed pocket, where the door is configured to enable the camera to take pictures and video through the windowed pocket when the door is in either the open or closed position. In some embodiments, the harness can position the pack ahead of a chest of an upper torso of the wearer, with the windowed pocket facing outwardly relative to the chest of the upper torso of the wearer so that the camera of the mobile device can act as a body camera for recording the wearer's interactions with the environment and others (e.g., in front of the wearer). Thus, the assembly can be used by a wearer during outdoor or indoor activities where a front-facing body camera is wanted, such as skiing, running, hiking, or other activities, or during law enforcement activities. Additionally, the assembly can incorporate spacers to angle the pack and, thus, the field of view of the camera upward or downward. For example, and upward-facing field of view may be beneficial in activities where the wearer is leaning forward, such as biking, snowmobiling, or other activities. Furthermore, in some embodiments, the harness can position the pack beside or ahead of the leg of the wearer, with the windowed pocket facing outwardly relative to the leg of the wearer so that the camera of the mobile device can act as a body camera for recording the wearer's interactions with the environment and others (e.g., in front of the wearer or beside the wearer). For example, the assembly can be used by a wearer during outdoor or indoor activities where a body camera is wanted and the wearer's legs are turned, such as snowboarding or other activities.

The invention has been described above with reference to illustrative embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A wearable pack assembly for a mobile device having a touchscreen and a camera, the wearable pack assembly comprising:

a harness including a base; and a pack removably coupled to the base, the pack including:

a windowed pocket having an inlet configured to receive the mobile device and to enable viewing and touching of the touchscreen and taking of pictures and video with the camera from the windowed pocket, and a door being movable between an open position away from the windowed pocket and a closed position at least partially covering the windowed pocket, the door configured to enable the camera to take pictures and video through the windowed pocket when the door is in the closed position, wherein the harness positions the pack ahead of a chest of an upper torso of a wearer, with the windowed pocket facing outwardly relative to the chest of the upper torso of the wearer, when the harness is worn on the upper torso of the wearer.

2. The wearable pack assembly according to claim 1, further comprising an engagement assembly removably coupling the pack to the base.

3. The wearable pack assembly according to claim 1, further comprising a spacer carried by the base, the spacer being configured to interact between the base and the chest of the upper torso of the wearer for concurrently tipping the base and the pack upwardly or downwardly relative to the chest of the upper torso of the wearer, when the harness is worn by the upper torso of the wearer.

4. The wearable pack assembly according to claim 1, further comprising a latch assembly configured to secure the door to the pack when the door is in the closed position, the latch assembly including a hook and loop fastener having an element thereof carried by the door and a complemental element thereof carried by the pack.

5. The wearable pack assembly of claim 1, wherein the harness includes a strap assembly coupled to the base.

6. The wearable pack assembly of claim 5, wherein the strap assembly includes a waist strap configured to extend around a waist of the wearer, shoulder straps configured to extend over shoulders of the wearer toward the back of the wearer, and a ring configured to interconnect the shoulder straps and the waist strap.

7. A wearable pack assembly for a mobile device having a touchscreen and a camera, the wearable pack assembly comprising:

a harness including a base and a strap assembly configured to be worn by a wearer; and a pack removably coupled to the base, the pack including:

a windowed pocket having an inlet configured to receive the mobile device and a window configured to enable viewing and touching of the touchscreen and taking of pictures and video with the camera from the windowed pocket through the window, and a door being movable between an open position away from the windowed pocket and a closed position partially covering the windowed pocket and leaving a portion of the window uncovered.

8. The wearable pack assembly of claim 7, wherein the pack includes a fastening element configured to close the inlet of the windowed pocket.

9. The wearable pack assembly of claim 7, wherein the pack is removably coupled to the base by one of hook and loop fasteners and buckles.

10. The wearable pack assembly of claim 7, wherein the pack includes a flap configured to secure the door in the closed position.

11. The wearable pack assembly of claim 7, wherein the door is positioned off-center between a first side edge and a second side edge of the pack and the windowed pocket is positioned equidistant between the first side edge and the second side edge.

12. The wearable pack assembly of claim 7 and further comprising a wedge-shaped spacer having an angled side configured to be coupled to an outer side of the base so as to tip the pack upward or downward when the pack is coupled to an inner side of the base.

13. The wearable pack assembly of claim 7, wherein the harness is configured to be worn on an upper torso of the wearer.

14. The wearable pack assembly of claim 13, wherein the strap assembly includes a left shoulder strap configured to extend over the wearer's left shoulder, a right shoulder strap configured to extend over the wearer's right shoulder, a waist strap configured to extend around the wearer's waist, and a back strap configured to be positioned along the wearer's back when the harness is worn by the wearer.

15. The wearable pack assembly of claim 14 and further comprising a tie-down ring configured to connect the right shoulder strap, the left shoulder strap, and the back strap, wherein the back strap is further coupled to the waist strap.

16. The wearable pack assembly of claim 13, wherein the strap assembly includes at least one buckle configured to be de-united and united to enable the wearer to put on the harness.

17. The wearable pack assembly of claim 7, wherein the harness is configured to be worn on a leg of the wearer.

18. The wearable pack assembly of claim 17, wherein the strap assembly includes a first upper strap configured to extend from a first side of the base, a second upper strap configured to extend from a second side of the base, and a leg strap configured to extend around the wearer's leg when the harness is worn by the wearer.

19. The wearable pack assembly of claim 18, wherein the first upper strap is configured to be coupled to a first ring releasably coupled to a first hook member, the second upper strap is configured to be coupled to a second ring releasably coupled to a second hook member, and the first hook member and the second hook member are configured to engage a belt of the wearer when the harness is worn by the wearer.

20. The wearable pack assembly of claim 17, wherein the strap assembly includes at least one buckle configured to be de-united and united to enable the wearer to put on the harness.

* * * * *